US009428964B2

(12) United States Patent
Hisada et al.

(10) Patent No.: US 9,428,964 B2
(45) Date of Patent: Aug. 30, 2016

(54) EXCAVATING TOOL

(71) Applicant: MITSUBISHI MATERIALS CORPORATION, Tokyo (JP)

(72) Inventors: Masaya Hisada, Anpachi-gun (JP); Kazuyoshi Nakamura, Anpachi-gun (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 106 days.

(21) Appl. No.: 14/360,714

(22) PCT Filed: Dec. 6, 2012

(86) PCT No.: PCT/JP2012/081654
§ 371 (c)(1),
(2) Date: May 27, 2014

(87) PCT Pub. No.: WO2013/084994
PCT Pub. Date: Jun. 13, 2013

(65) Prior Publication Data

US 2015/0300094 A1 Oct. 22, 2015

(30) Foreign Application Priority Data

Dec. 9, 2011 (JP) ..... 2011-269956

(51) Int. Cl.
*E21B 10/40* (2006.01)
*E21B 7/20* (2006.01)
(Continued)

(52) U.S. Cl.
CPC . *E21B 10/40* (2013.01); *E21B 7/20* (2013.01); *E21B 10/42* (2013.01); *E21B 10/64* (2013.01)

(58) Field of Classification Search
CPC ..... E21B 10/40; E21B 10/26; E21B 10/64
See application file for complete search history.

(56) References Cited

U.S. PATENT DOCUMENTS 4,362,217 A * 12/1982 Fletcher ..... E21B 7/20 175/171
4,962,822 A * 10/1990 Pascale ..... E21B 7/208 175/258

(Continued)

FOREIGN PATENT DOCUMENTS

CA 2496199 A1 8/2005
CN 2049260 U 12/1989

(Continued)

OTHER PUBLICATIONS

Office Action mailed May 20, 2015, issued for the Chinese patent application No. 201280058393.0 and partial English translation of search report.

(Continued)

*Primary Examiner* — Shane Bomar
(74) *Attorney, Agent, or Firm* — Locke Lord LLP

(57) ABSTRACT

An excavating tool includes a casing pipe that forms a cylindrical shape about an axis line and in which a stepped portion whose inner diameter is decreased by one step is formed in an inner peripheral portion of an distal end; an inner bit where a contact portion which can come into contact with the stepped portion is formed in an outer periphery, which is inserted into the casing pipe, and whose distal end portion protrudes from a distal end of the casing pipe; an engagement convex portion that is disposed on the outer periphery of the distal end portion of the inner bit so as to be retractable; a ring bit that forms an annular shape and is arranged around the distal end portion of the inner bit; and an engagement concave portion that is formed in an inner peripheral portion of the ring bit.

6 Claims, 18 Drawing Sheets

(51) Int. Cl.
*E21B 10/64* (2006.01)
*E21B 10/42* (2006.01)

(56) References Cited

U.S. PATENT DOCUMENTS

| | | | | |
|---|---|---|---|---|
| 5,259,469 | A | 11/1993 | Stjernström et al. | |
| 5,472,057 | A | 12/1995 | Winfree | |
| 5,590,726 | A * | 1/1997 | Jarvela | E21B 7/20 175/257 |
| 7,143,846 | B2 | 12/2006 | Järvelä et al. | |
| 7,185,717 | B2 * | 3/2007 | Holte | E21B 10/64 175/171 |
| 8,118,115 | B2 * | 2/2012 | Roussy | E21B 6/00 175/56 |
| 2009/0214299 | A1 * | 8/2009 | Roussy | E21B 6/00 405/239 |
| 2010/0236831 | A1 * | 9/2010 | Nakamura | E21B 10/327 175/292 |

FOREIGN PATENT DOCUMENTS

| | | | | |
|---|---|---|---|---|
| CN | 1090367 | A | 8/1994 | |
| CN | 1180129 | A | 4/1998 | |
| CN | 1223323 | A | 7/1999 | |
| CN | 1599832 | A | 3/2005 | |
| CN | 2685530 | Y | 3/2005 | |
| CN | 101525982 | A | 9/2009 | |
| CN | 201714302 | U | 1/2011 | |
| EP | 1837481 | A1 | 9/2007 | |
| JP | 2759437 | B2 | 5/1998 | |
| JP | 2001-140578 | A | 5/2001 | |
| JP | 2006-037613 | A | 2/2006 | |
| JP | 2007-255106 | A | 10/2007 | |
| JP | 2011-021411 | A | 2/2011 | |
| TW | 200736489 | A | 10/2007 | |
| WO | WO-96/18798 | A1 | 6/1996 | |
| WO | WO 2009156569 | A1 * | 12/2009 | E21B 7/208 |
| WO | WO-2011/055001 | A1 | 5/2011 | |

OTHER PUBLICATIONS

Office Action mailed Jun. 29, 2015, issued for the Australian patent application No. 2012349363.

International Search Report mailed Jan. 15, 2013, issued for PCT/JP2012/081654.

Search Report dated Dec. 8, 2015, issued for the European patent application No. 12856151.1.

* cited by examiner

EXCAVATING TOOL

TECHNICAL FIELD

The present invention relates to an excavating tool in which a distal end portion of an inner bit inserted into a casing pipe is protruded from a distal end of the casing pipe and engages with a ring bit arranged in the distal end of the casing pipe so as to be integrally rotatable, and which causes the inner bit and the ring bit to excavate the ground to form a bore and concurrently inserts the casing pipe into the bore.

Priority is claimed on Japanese Patent Application No. 2011-269956, filed Dec. 9, 2011, the content of which is incorporated herein by reference.

BACKGROUND ART

As an excavating tool which inserts a casing pipe concurrently with ground excavation, in PTLs 1 and 2, the present inventors have proposed an excavating tool in which a ring bit is rotatable with respect to a casing pipe and is locked in a direction of an axis line of the casing pipe by using locking means such as a locking member so that the ring bit does not inadvertently fall out during excavation. This excavating tool carries out excavation work by transmitting rotating force applied to an inner bit to the ring bit and by transmitting thrust force or striking force applied to a distal end side of the inner bit in the direction of the axis line to the casing pipe and the ring bit. The thrust force or the striking force from the inner bit to the ring bit is transmitted via the casing pipe or directly.

In the excavating tool whose ring bit is locked in the direction of the axis line in the distal end of the casing pipe in this way, there is no problem when the casing pipe is left inside the bore. However, when the casing pipe is temporarily inserted into the bore and the used casing pipe is lifted up from the bore so as to be collected on the ground, such as when the casing pipe is replaced with a building member or is used as a temporary pile, there is a possibility that efficient collection may be difficult. This is because the ring bit locked in the distal end of the casing pipe causes an increase in resistance between an inner peripheral surface of the bore and the ring bit due to its outer diameter larger than that of the casing pipe, thereby excessive lifting force is required.

Therefore, in PTL 3, the present inventors have further proposed the excavating tool in which the above-described locking means includes a pulling-out mechanism for pulling out the ring bit from the casing pipe to the distal end side in the direction of the axis line, and which causes the pulling-out mechanism to pull out the ring bit from the casing pipe to the distal end side in the direction of the axis line after the bore into which the casing pipe is inserted is formed to reach a predetermined depth. According to this excavating tool, the ring bit is removed by being pulled out from the distal end of the casing pipe. In this manner, without causing the increased resistance between the inner peripheral surface of the bore and the ring bit, it is possible to lift up and collect only the casing pipe from the bore.

CITATION LIST

Patent Literature

[PTL 1] Japanese Unexamined Patent Application, First Publication No. 2001-140578

[PTL 2] Japanese Unexamined Patent Application, First Publication No. 2006-37613

[PTL 3] Japanese Unexamined Patent Application, First Publication No. 2007-255106

SUMMARY OF INVENTION

Problem to be Solved by the Invention

In the excavating tool disclosed in PTL 3, in order to pull out the ring bit from the distal end of the casing pipe by using the above-described pulling-out mechanism, the inner bit is temporarily drawn out from the casing pipe after the bore is formed to reach the predetermined depth. Then, a second inner bit whose outer diameter is smaller than that of the inner bit is inserted into the casing pipe so as to engage with the ring bit. The ring bit is configured to be pulled out by protruding this second inner bit from the distal end of the casing pipe.

Therefore, in the above-described excavating tool disclosed in PTL 3, as a matter of course, it is necessary to dispose the second inner bit which can engage with the ring bit. When the formed bore is deep, it is difficult to collect the casing pipe by efficiently pulling out the ring bit and lifting up the casing pipe. This is because in order to protrude the second inner bit from the distal end of the casing pipe, it is necessary to additionally connect multiple excavating rods to the rear end side of the second inner bit, thereby the multiple excavating rods are required and it takes time and effort to connect the multiple excavating rods.

The present invention is made in view of the above-described circumstances, and an object thereof is to provide an excavating tool which can efficiently lift up a casing pipe by enabling a ring bit to be pulled out without depending on the above-described second inner bit or the like.

Means for Solving the Problem

In order to solve the above-described problem and to achieve the object, according to the present invention, there is provided an excavating tool including a casing pipe that forms a cylindrical shape about an axis line and in which a stepped portion whose inner diameter is decreased by one step is formed in an inner peripheral portion of an distal end; an inner bit which has a contact portion which can come into contact with the stepped portion on an outer periphery, and is inserted into the casing pipe from a rear end side in the direction of the axis line to protrude its distal end portion from a distal end of the casing pipe; an engagement convex portion that is disposed on the outer periphery of the distal end portion of the inner bit so as to be retractable; a ring bit that forms an annular shape and is arranged around the distal end portion of the inner bit protruding from the distal end of the casing pipe; and an engagement concave portion that is formed in an inner peripheral portion of the ring bit. The ring bit is rotatable around the axis line integrally with the inner bit in a rotating direction during excavation, and the ring bit is locked so as not to be pulled out to the distal end side in the direction of the axis line in such a manner that the engagement convex portion protrudes to an outer peripheral side and engages with the engagement concave portion. The ring bit can be pulled out to the distal end side in such a manner that the engagement convex portion is retracted to an inner peripheral side.

In the excavating tool configured as described above, the contact portion of the inner bit inserted into the casing pipe comes into contact with the stepped portion of the casing pipe. In this manner, the thrust force or the striking force to the distal end side in the direction of the axis direction which is applied to the inner bit is transmitted to the casing pipe, and the casing pipe is inserted into the bore formed by the inner bit and the ring bit. On the other hand, the engagement convex portion is disposed to be retractable to the outer periphery of the distal end portion of the inner bit which protrudes from the distal end of the casing pipe. The engagement convex portion protrudes to the outer peripheral side and engages with the engagement concave portion formed in the inner peripheral portion of the ring bit arranged around the distal end portion of the inner bit. In this manner, the ring bit is rotatable around the axis line integrally with the inner bit in the rotating direction during the excavation. Then, the rotating force is transmitted to the ring bit, and the ring bit is locked so as not to slip from the distal end side in the direction of the axis line.

Then, the engagement convex portion retractable to the outer periphery of the distal end portion of the inner bit retreats to the inner peripheral side and retracts from the engagement concave portion of the inner peripheral portion of the ring bit. In this manner, the engagement is disengaged between the engagement concave portion and the engagement convex portion, the locking of the ring bit to the distal end side in the direction of the axis line is also unlocked, and the ring bit can be pulled out. According to the excavating tool configured as described above, it is not necessary to dispose a second inner bit or to additionally connect an excavating rod for engaging the second inner bit with the ring bit. It is possible to pull out and detach the ring bit by a retractable operation of the engagement convex portion as described above. Therefore, after the inner bit is drawn out from the casing pipe and the casing pipe is temporarily used, it is possible to draw out only the casing pipe from the bore by leaving the ring bit in the bore. Accordingly, it is possible to efficiently collect the casing pipe without causing the ring bit having the large outer diameter to increase the resistance.

In addition, in the excavating tool configured as described above, in a state where the contact portion of the inner bit is in contact with the stepped portion of the casing pipe and the engagement convex portion of the inner bit engages with the engagement concave portion formed in the inner peripheral portion of the ring bit, a rear end surface of the ring bit can come into contact with a distal end surface of the casing pipe. In this manner, the contact between the stepped portion and the contact portion enables the thrust force or the striking force to the distal end side in the direction of the axis line which is applied from the inner bit to the casing pipe to be also transmitted from the casing pipe to the ring bit.

Therefore, it is possible to more efficiently form the bore by using the ring bit rotated integrally with the inner bit during the excavation. As in a case where the thrust force or the striking force is directly transmitted from the inner bit to the ring bit, it is not necessary to decrease the inner diameter of the ring bit further than the inner diameter of the stepped portion. Therefore, it is possible to decrease the thickness of the ring bit or to decrease the diameter of the casing pipe with respect to the outer diameter of the building member when the casing pipe is replaced with the building member as described above. Thus, it is possible to reduce the cost required for the excavation.

On the other hand, as described above, the engagement convex portion is disposed to be retractable to the outer periphery of the distal end portion of the inner bit, and is protruded to the outer peripheral side to engage with the engagement concave portion of the inner peripheral portion of the ring bit. In order to be capable of pulling out the ring bit by causing the engagement convex portion to retreat to the inner peripheral side, the engagement convex portion is biased toward the outer peripheral side, and is disposed to be retractable to the outer periphery of the distal end portion of the inner bit. A guide wall tilting toward the inner peripheral side of the ring bit as the ring bit goes toward the rear end side is formed in the rear end portion of the engagement concave portion. This causes a state where the engagement convex portion biased against and protruded to the outer peripheral side engages with the engagement concave portion to be changed to a state where the engagement convex portion is in contact with the guide wall, and further causes the inner bit to retreat to the rear side in the direction of the axis line. In this manner, it is possible to cause the engagement convex portion to retreat to the inner peripheral side against biasing force by guiding and bringing the engagement convex portion into sliding contact with the guide wall of the engagement concave portion. Therefore, it is possible to pull out the ring bit by using a simple structure and reliably disengaging the engagement between the engagement concave portion and the engagement convex portion.

In a case where the guide wall is disposed in the rear end portion of the engagement concave portion as described above and the engagement convex portion is biased toward the outer peripheral side by a compression coil spring, spring constant K (N/mm) of the compression coil spring is configured to be $K>W/(\tan\theta \times h \times n)$ when an weight W (N) of the ring bit, a tilt angle $\theta(°)$ of the guide wall with respect to the axis line, a height h (mm) for hooking the engagement convex portion, which is a radial distance with respect to the axis line from an inner peripheral surface of the ring bit to a protruding end of the engagement convex portion protruding to the outer peripheral side of the inner bit, and the number n of the engagement convex portions disposed in the inner bit are respectively set. In this manner, even in a state where the ring bit is caused to face downward and then the engagement convex portion is in contact with the guide wall, it is possible to prevent the ring bit from inadvertently falling out due to its own weight.

Effects of the Invention

As described above, according to the present invention, it is possible to form a bore by using an inner bit and a ring bit during excavation and to insert a casing pipe into the bore. After the bore is formed to reach a predetermined depth, it is not necessary to dispose a second inner bit or an excavating rod to be additionally connected to a rear end side of the second inner bit. The ring bit can be pulled out by causing an engagement convex portion of the inner bit to retreat. In this manner, it is possible to efficiently lift up and collect only the casing pipe from the bore by leaving the ring bit in the bore.

DESCRIPTION OF EMBODIMENTS

Figure 1:
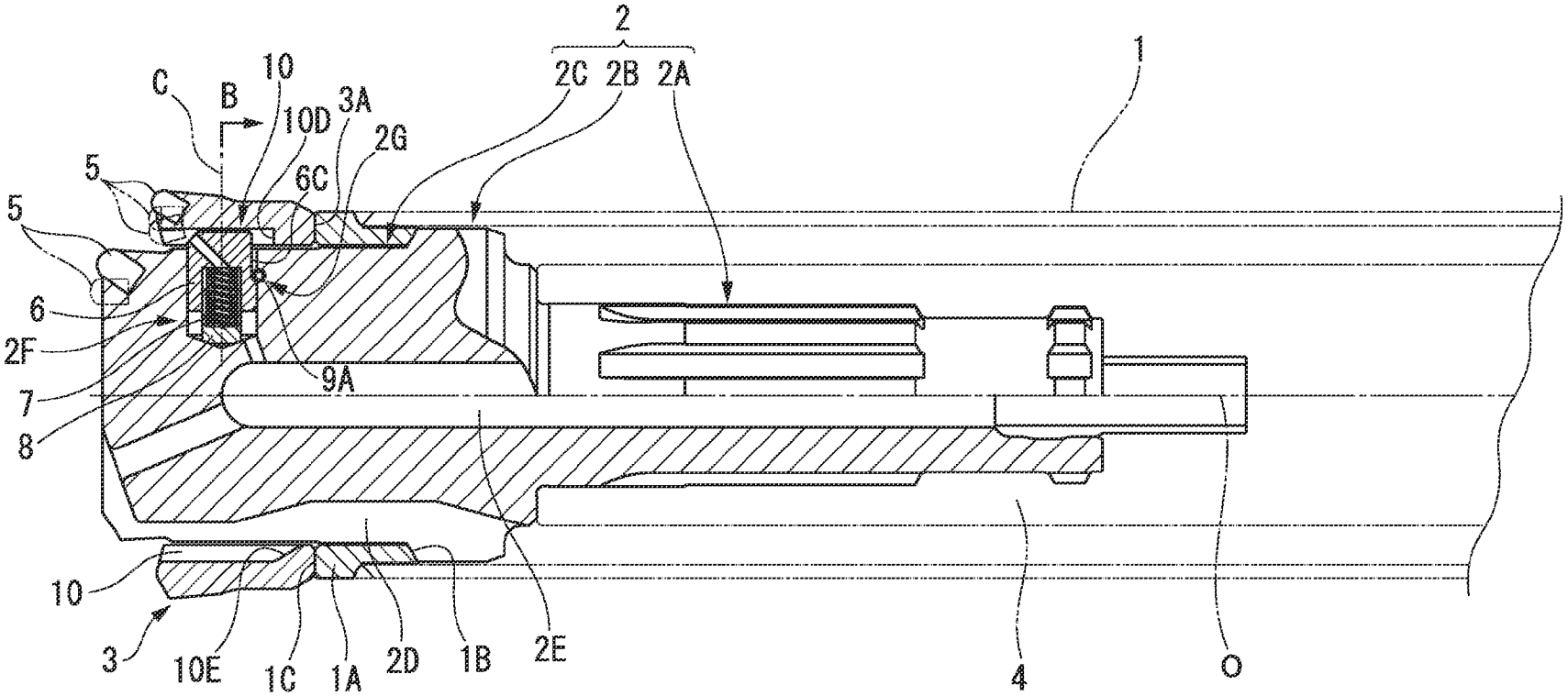
FIG. 1 is a side cross-sectional view (cross-sectional view taken along line AA in FIG. 2) of an excavating tool during excavation, which illustrates an embodiment of the present invention.

FIGS. 1 to 14D illustrate an embodiment of the present invention. FIGS. 15A to 16B are views for describing a case where excavation work is carried out by using an excavating tool of this embodiment. In the present embodiment, a casing pipe 1 is formed of a steel material, and forms a cylindrical shape about an axis line O. When necessary, multiple casing pipes 1 are sequentially and additionally connected in a direction of the axis line O. The multiple casing pipes 1, being led by an inner bit 2, are inserted into a bore H which is formed by the inner bit 2 protruding in a further distal end side of the forefront casing pipe 1 and a ring bit 3 arranged around the inner bit 2.

A casing top 1A also formed of the steel material is bonded and integrally attached to a further distal end portion of the forefront casing pipe 1 out of the casing pipes 1 which are additionally connected in this way when necessary. Whereas the casing top 1A has an inner diameter smaller than that of the casing pipe 1 by one step, an outer diameter of a distal end side (left side in FIGS. 1, 4, 7A and 7B) is equal to that of the casing pipe 1. A rear end side (right side in FIGS. 1, 4, 7A and 7B) forms a multi-step cylindrical shape having an allowable size for being fitted and inserted into the casing pipe 1. In the casing top 1A, a rear end side portion is bonded and attached, by welding, to the casing pipe 1 after being fitted and inserted into the forefront casing pipe 1 from the distal end side.

Therefore, a stepped portion 1B whose inner diameter is decreased by one step due to the casing top 1A is formed in an inner peripheral portion of the distal end of the forefront casing pipe 1. In the present embodiment, the stepped portion 1B is configured so that the rear end surface facing the rear end side in the direction of the axis line O is a tapered surface about the axis line O, which is tilted toward the distal end side as the surface goes toward the inner peripheral side. In addition, a distal end surface 1C of the casing top 1A which is opposite to the rear end surface is configured to have an annular surface perpendicular to the axis line O in the present embodiment.

On the other hand, an excavator (not illustrated) which applies rotating force in a rotating direction T around the axis line O and thrust force toward the distal end side in the direction of the axis line O to excavating rods during excavation is arranged on the ground where the bore H is formed. When necessary, similar to the casing pipe 1, the multiple excavating rods are sequentially and additionally connected and inserted into the casing pipe 1 along the axis line O from the excavator. A down-the-hole hammer 4 is attached to the distal end of the forefront excavating rod out of the multiple excavating rods, and the inner bit 2 is attached to the distal end of the down-the-hole hammer 4. The down-the-hole hammer 4 is inserted through the rear end side of the casing pipe 1, and applies the striking force to the distal end side in the direction of the axis line O by using compressed air supplied from the excavator to the down-the-hole hammer 4.

The inner bit 2 is configured so that main body thereof is integrally formed of a steel material in a multi-step cylindrical external shape about the axis line O which is coaxial with the casing pipe 1. The rear end portion of the main body serves as a shank portion 2A to be attached to the down-the-hole hammer 4. The distal end side of the shank portion 2A serves as a disc-shaped contact portion 2B about the axis line O, which has the outer diameter slightly smaller than the inner diameter of the casing pipe 1 and larger than the inner diameter of the casing top 1A and is the largest outer diameter portion of the inner bit 2. The distal end surface of the contact portion 2B is a tapered surface about the axis line O, which is tilted toward the distal end side as the surface goes toward the inner peripheral side, at a tilt angle equal to that of the rear end surface of the stepped portion 1B formed by the casing top 1A.

A distal end portion 2C of the inner bit 2 of the further distal end side from the contact portion 2B has a substantially cylindrical external shape about the axis line O, which has the outer diameter slightly smaller than the inner diameter of the casing top 1A. Here, a length of the distal end portion 2C up to the distal end surface of the distal end portion 2C, that is, up to the distal end surface of the inner bit 2, is longer than a length in which lengths of the casing top 1A and the ring bit 3 in the direction of the axis line O are combined with each other.

Furthermore, a central portion of the distal end surface of the distal end portion 2C is a flat surface perpendicular to the axis line O, and an outer peripheral edge portion thereof is a tapered surface which is tilted toward the distal end side as the surface goes toward the inner peripheral side. Then, multiple tips 5 which are formed of hard materials such as ultra-hard alloys and are used in excavating the ground are embedded in the central portion and the outer peripheral edge portion of the distal end surface, so as to be respectively perpendicular to the flat surface formed by the central portion and the tapered surface formed by the outer peripheral edge portion.

In addition, a discharge groove 2D for discharging sludge generated by the tips 5 during the excavation is formed from the distal end surface to the outer peripheral surface in the distal end portion 2C and the contact portion 2B of the inner bit 2. The discharge groove 2D is configured so that a groove bottom thereof in the distal end surface has a concavely curved shape which is curved in a circumferential direction of the inner bit 2. The discharge groove 2D is formed so as to radially extend to the outer peripheral side with respect to the axis line O from a position which is slightly separated from the center of the distal end surface to the outer peripheral side and so that a groove depth is gradually deeper.

Furthermore, the discharge groove 2D in the outer peripheral surface is configured to have a U-shape in cross section which is wider in the circumferential direction than the distal end surface, and communicates with an outer peripheral end of the discharge groove 2D of the distal end surface. The discharge groove 2D extends toward the rear end side in parallel with the axis line O with a constant groove depth, and then extends so that the groove depth is gradually deeper. Thereafter, the discharge groove 2D extends again with the constant groove depth, then extends so that the groove depth is gradually shallower, and is open on the rear end surface of the contact portion 2B. In the present embodiment, multiple (three) discharge grooves 2D as described above are formed at equal intervals in the circumferential direction.

Furthermore, a blow hole 2E for discharging the compressed air supplied to the down-the-hole hammer 4 is formed inside the inner bit 2, along the axis line O from the rear end of the shank portion 2A toward the distal end side. The blow hole 2E is divided into multiple small-diameter holes in the distal end portion 2C of the inner bit 2, and the small-diameter holes are respectively open in a groove bottom of the discharge groove 2D on the distal end surface.

Furthermore, a recess 2F which is recessed to the inner peripheral side in the radial direction is formed on the outer peripheral surface of the distal end portion 2C of the inner bit 2. The engagement convex portion 6 is accommodated in the recess 2F so as to be retractable to the outer peripheral side. Here, the recess 2F is a circular hole in cross section with a constant inner diameter, which has a central axis C orthogonal to the axis line O, and is formed with a depth which does not reach the blow hole 2E along the axis line O. However, from the blow hole 2E to the recess 2F, divided holes which have the diameter smaller than that of the small-diameter holes divided toward the groove bottom of the discharge groove 2D of the distal end surface are formed. The divided holes are open on a peripheral edge portion of a bottom surface of the recess 2F.

In the present embodiment, the recess 2F as described above is formed one by one on the rear side in the rotating direction T of the inner bit 2 during the excavation, between the respective discharge grooves 2D which are adjacent to each other on the outer peripheral surface of the distal end portion 2C. That is, multiple (three) recesses 2F having the same number as the number of the discharge grooves 2D are formed at equal intervals in the circumferential direction. The engagement convex portions 6 are respectively accommodated in the corresponding recesses 2F. In the present embodiment, the inner bit 2 and the ring bit 3 have a rotationally symmetric shape in the circumferential direction around the axis line O at each angle in which 360 degrees are divided by the number of the engagement convex portions 6 (in the present embodiment, 360 degrees/3=120 degrees), excluding the arrangement of the tips 5 embedded in the distal end thereof.

In addition, the distal end portion 2C of the inner bit 2 has a pin hole 2G along a tangential line extending on a plane orthogonal to the axis line O in the rear end side of the recess 2F in the direction of the axis line O, out of tangential lines of a circle formed by the inner peripheral surface of the recess 2F in cross section orthogonal to the central axis C, from the rotating direction T side with respect to the recess 2F on the outer peripheral surface between the discharge grooves 2D adjacent to each other in the circumferential direction. The pin hole 2G is open on the inner peripheral surface of the recess 2F so that a central line thereof comes into contact with the circle formed by the cross section of the inner peripheral surface of the recess 2F, and then reaches the discharge groove 2D formed on the outer peripheral surface of the distal end portion 2C of the rear side in the rotating direction T of the recess 2F. In this manner, in a side reaching the discharge groove 2D, the inner diameter of the pin hole 2G is decreased by one step.

Figure 12A:
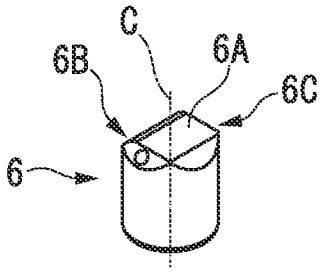
FIG. 12A is a perspective view illustrating the engagement convex portion of the embodiment illustrated in FIG. 1.

The engagement convex portion 6 accommodated in the recess 2F is formed of the steel material. As illustrated in FIGS. 12A, 12C and 12D, a proximal end side thereof (lower side in FIGS. 12A, 12C and 12D) is adapted to have an allowable outer diameter for being fitted and inserted into the recess 2F, and to have a cylindrical shape about the central axis C which is coaxial with the recess 2F.

Figure 12B:
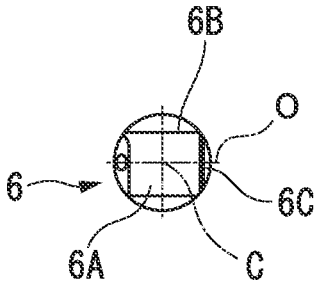
FIG. 12B is a plan view illustrating the engagement convex portion.
Figure 12C:
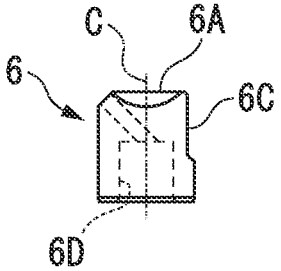
FIG. 12C is a side view illustrating the engagement convex portion.
Figure 12D:
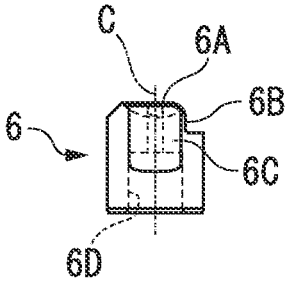
FIG. 12D is a rear view illustrating the engagement convex portion.

On the other hand, a protruding end surface 6A of the engagement convex portion 6 which faces the outer peripheral side of the inner bit 2 in a state where the engagement convex portion 6 is accommodated in the recess 2F has a rectangular surface perpendicular to the central axis C, which has a longitudinal direction in a direction parallel to the axis line O in that state and is inscribed in a circle formed by the outer peripheral surface of the proximal end side portion as illustrated in FIG. 12B.

Out of four sides on a rectangular surface formed by the protruding end surface 6A, side portions of the protruding end surface 6A on the outer peripheral surface of the engagement convex portion 6 connected to a side facing the distal end side in the direction of axis line O in the state where the engagement convex portion 6 is accommodated in the recess 2F and a side facing the rear side of the rotating direction T are respectively and obliquely chamfered along the side toward the proximal end side as the side portions go toward the outer peripheral side of the engagement convex portion 6, being perpendicular to the sides. In addition, the outer peripheral surface of the engagement convex portion 6 which is connected to the remaining sides out of four sides of the protruding end surface 6A, that is, a side facing the rear end side in the direction of axis line O in the state where the engagement convex portion 6 is accommodated in the recess 2F and a side facing the rotating direction T side is cut out toward the proximal end side of the engagement convex portion 6 by a plane extending in a direction orthogonal to the rectangular surface in the respective sides, and then is formed so as to be cut upward on the outer peripheral side.

Out of the planes, the plane facing the rotating direction T side in the state where the engagement convex portion 6 is accommodated in the recess 2F is an engagement surface 6B of the engagement convex portion 6. The side which is positioned in the rotating direction T side on the rectangular surface and in which the engagement surface 6B and the protruding end surface 6A intersect each other is chamfered into a quarter convex arc shape in cross section so as to come into smooth contact with the engagement surface 6B and the protruding end surface 6A. On the other hand, the plane which faces the rear end side in the direction of the axis line O in the state where the engagement convex portion 6 is similarly accommodated in the recess 2F and which is perpendicular to the axis line O is a locking surface 6C. The side in which the locking surface 6C and the protruding end surface 6A intersect each other is also chamfered into the quarter convex arc shape in cross section whose radius is smaller than that of the side of the engagement surface 6B. In addition, the locking surface 6C is configured so that the length thereof in the direction of the central axis C is longer than that of the engagement surface 6B, and a portion cut upward on the outer peripheral side of the engagement convex portion 6 from the locking surface 6C forms a concavely curved surface in the quarter convex arc shape in cross section whose radius is equal to the radius of the pin hole 2G.

Furthermore, a recessed hole 6D which has a circular shape in cross section and is centered on the central axis C is formed from the proximal end surface toward the protruding end side inside the engagement convex portion 6. The recessed hole 6D extends from the proximal end surface toward the protruding end side by crossing over a position where the locking surface 6C is cut upward, and is formed so as to have a hole bottom in front of a position where the engagement surface 6B is cut upward. In addition, the small-diameter hole extends from the center of the hole bottom of the recessed hole 6D to the side opposite to the locking surface 6C as the small-diameter hole goes toward the protruding end side. Out of the chamfered portions formed in the protruding end side portion of the engagement convex portion 6 as described above, the small-diameter hole is open on the chamfered portion along the side facing the distal end side in the direction of the axis line O in the state where the engagement convex portion 6 is accommodated in the recess 2F.

Figure 13:
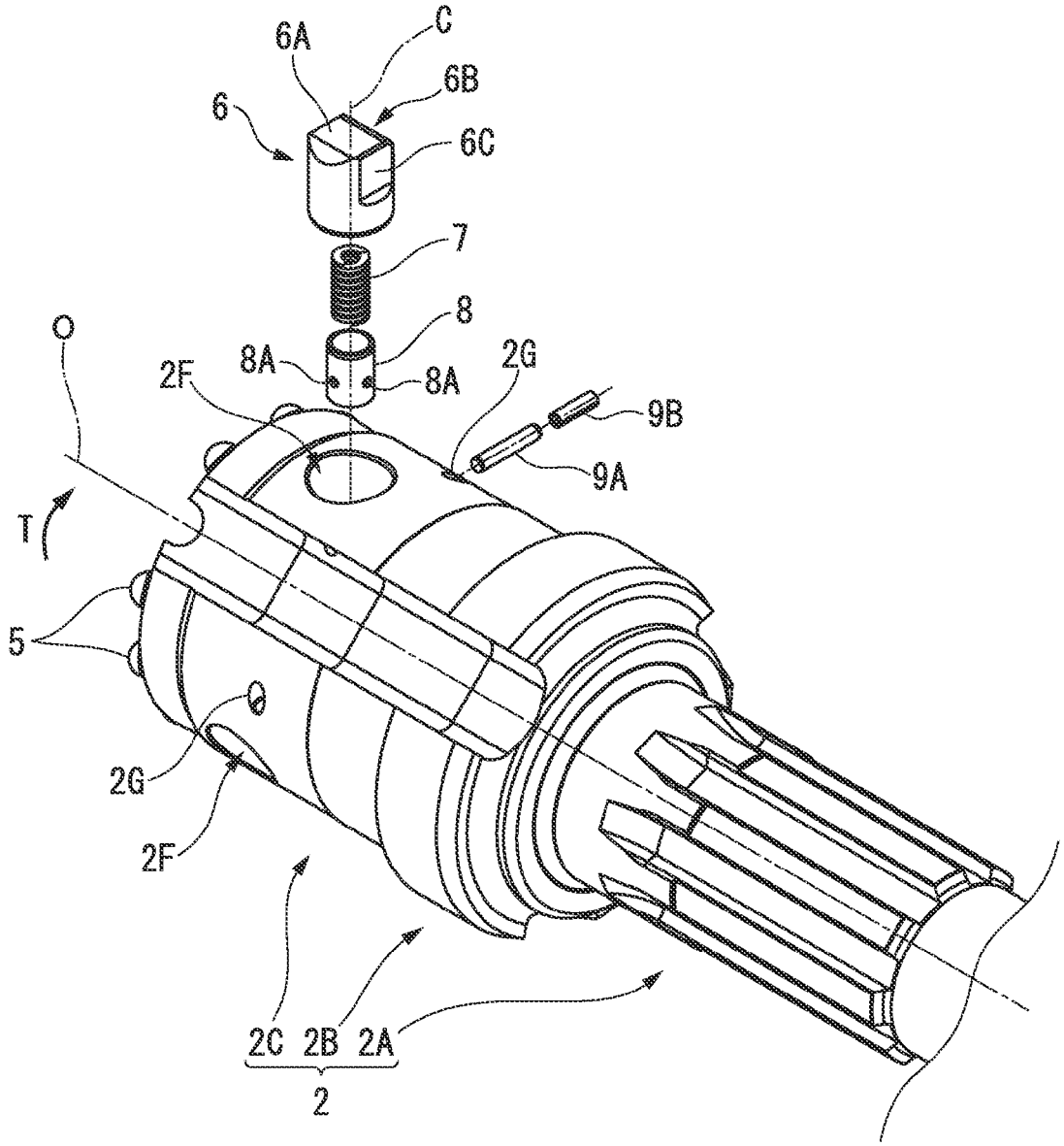
FIG. 13 is an assembly view when the engagement convex portion is attached to the inner bit in the embodiment illustrated in FIG. 1.
Figure 14A:
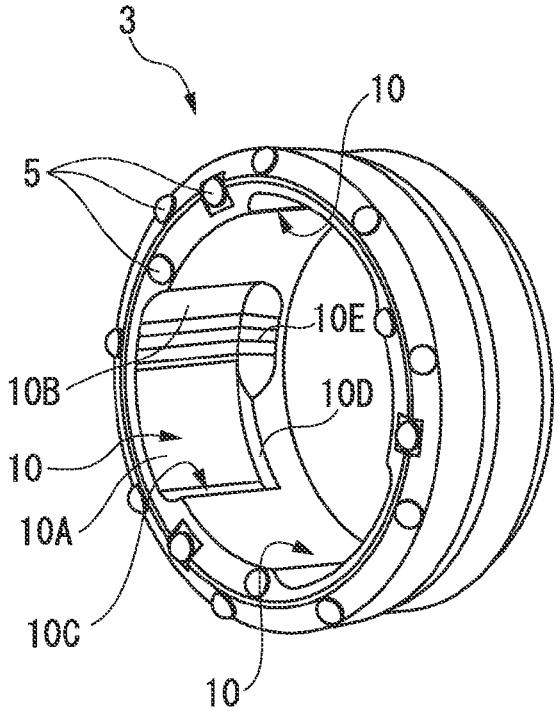
FIG. 14A is a perspective view illustrating the ring bit of the embodiment illustrated in FIG. 1.
Figure 14B:
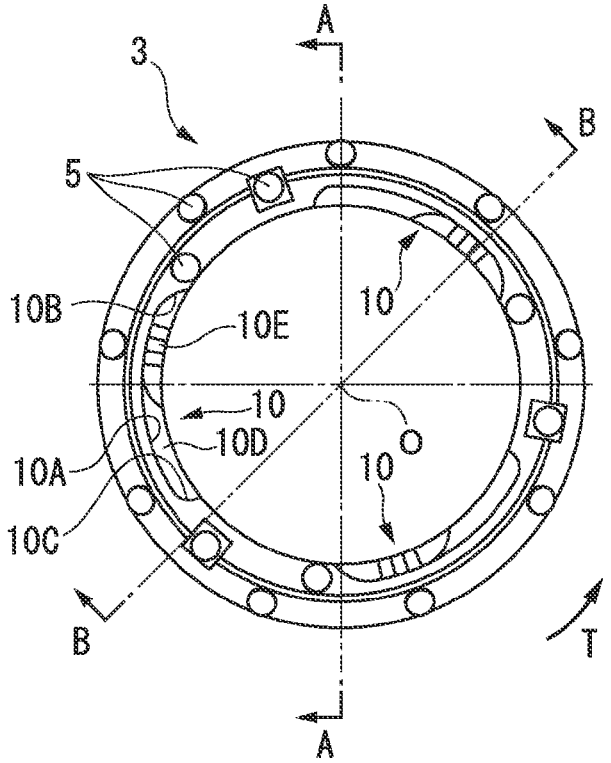
FIG. 14B is a front view illustrating the ring bit.
Figure 14C:
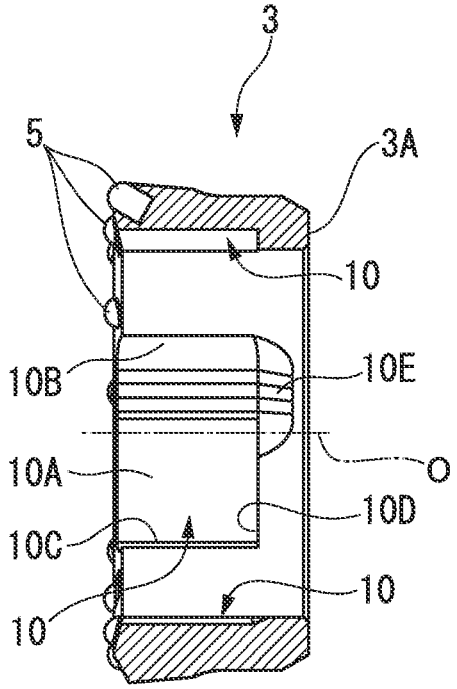
FIG. 14C is a cross-sectional view taken along line AA in FIG. 14B illustrating the ring bit.
Figure 14D:
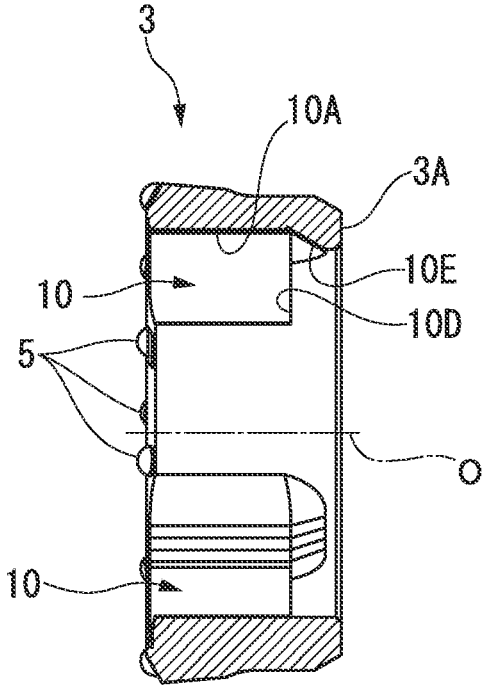
FIG. 14D is a cross-sectional view taken along line BB in FIG. 14B illustrating the ring bit.

As illustrated in FIG. 13, as retracting mechanism which can retract the engagement convex portion 6 to the outer peripheral side of the inner bit 2, the recessed hole 6D accommodates a compression coil spring 7 serving as biasing means for biasing the engagement convex portion 6 toward the outer peripheral side in the present embodiment and a holding member 8 for holding the compression coil spring 7. The holding member 8 is formed in a bottomed cylindrical shape, the outer diameter thereof has an acceptable size for being fitted and inserted into the recessed hole 6D, and is inserted into the recessed hole 6D coaxially with the central axis C in a state where the opening portion opposite to the bottom portion thereof is caused to face the protruding end side of the engagement convex portion 6. Multiple (in the present embodiment, four at equal intervals in the circumferential direction) through-holes 8A radially penetrating at intervals in the circumferential direction are formed in the cylindrical portion of the holding member 8.

In addition, the compression coil spring 7 is twisted to form a spiral shape around the central axis C, and has an acceptable outer diameter for being fitted and inserted into the inner peripheral portion of the holding member 8. When not in a compressed state, the compression coil spring 7 has a length in the direction of the central axis C which is longer than a length of the cylindrical portion from the bottom surface of the inner peripheral portion to the opening portion of the holding member 8. In a state where the compression coil spring 7 is held inside the holding member 8 by bringing one end in the direction of the central axis C into contact with the bottom surface of the inner peripheral portion, the other end is adapted to have a length required for protruding from the opening portion of the holding member 8.

Figure 7A:
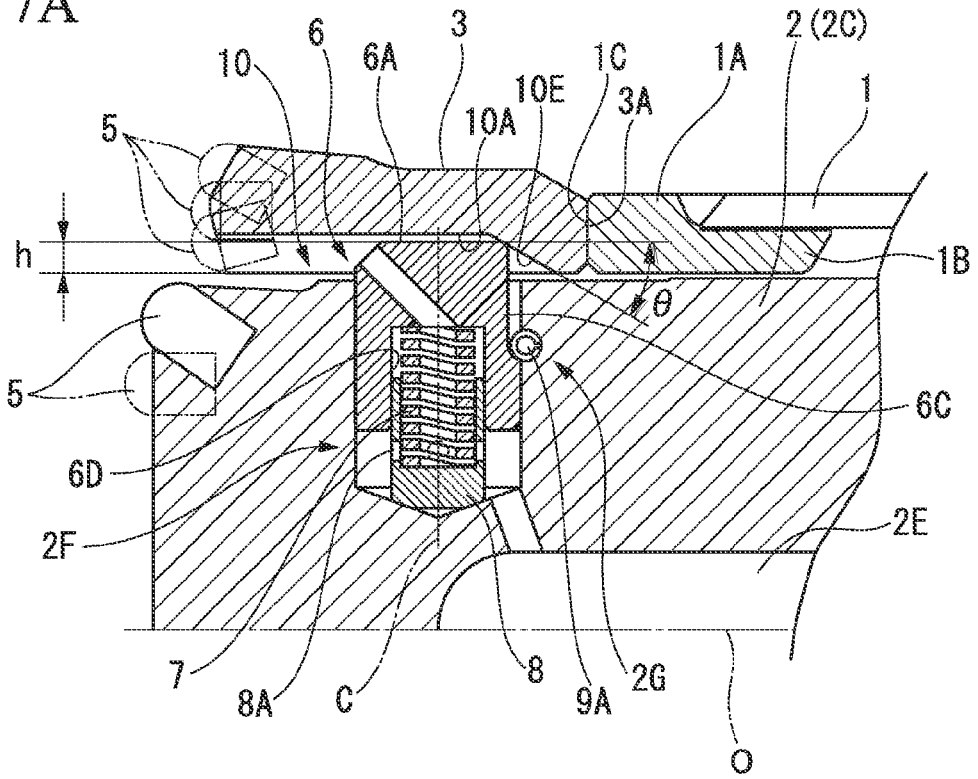
FIG. 7A is an enlarged side cross-sectional view in a state where an inner bit is caused to retreat and the engagement convex portion is brought into contact with a guide wall, which is changed from a state illustrated in FIG. 4.
Figure 7B:
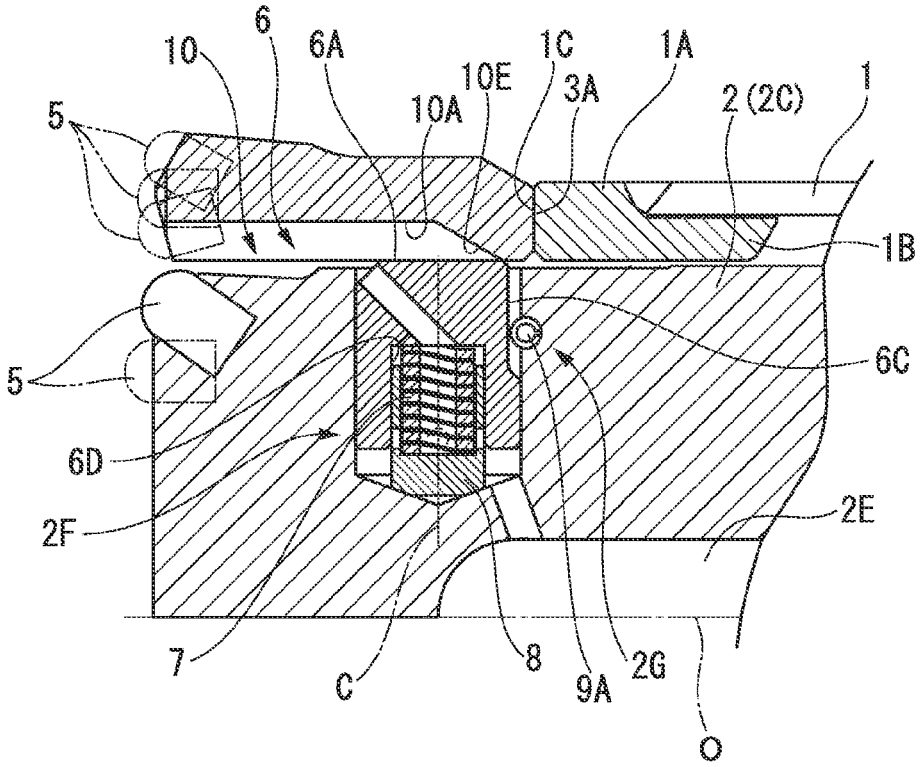
FIG. 7B is an enlarged side cross-sectional view in a state where the inner bit is caused to further retreat, which is changed from the state illustrated in FIG. 7A.

Here, in the present embodiment, spring constant K (N/mm) of the compression coil spring 7 is configured to be $K>W/(\tan\theta \times h \times n)$ when a weight W (N) of the ring bit 3, a tilt angle θ(°) of a guide wall (to be described later) which is formed in the ring bit 3 as illustrated in FIGS. 7A and 7B, with respect to the axis line O, a height h (mm) for hooking the engagement convex portion 6, which is a radial distance with respect to the axis line O from an inner peripheral surface of the ring bit 3 to a protruding end of the engagement convex portion 6 protruding to the outer peripheral side of the inner bit 2, and the number n of the engagement convex portions 6 disposed in the inner bit 2 are respectively set.

The holding member 8 which holds the above-described compression coil spring 7 in the inner peripheral portion is inserted into the recessed hole 6D of the engagement convex portion 6 as described above, and the other end of the compression coil spring 7 comes into contact with the hole bottom of the recessed hole 6D. In this state, the engagement convex portion 6 is accommodated in the recess 2F by causing the engagement surface 6B to face the rotating direction T side and the locking surface 6C to face the rear end side in the direction of the axis line O, and the bottom portion of the holding member 8 comes into contact with the bottom surface of the recess 2F.

Then, from this state, the engagement convex portion 6 is further pressed into the recess 2F against the biasing force of the compression coil spring 7. When the cut-upward portion of the locking surface 6C is positioned at the further inner peripheral side of the inner bit 2 than the pin hole 2G which is open on the inner peripheral surface of the recess 2F, as illustrated in FIG. 13, a pin 9A is fitted and inserted into the pin hole 2G from the rotating direction T side. Then, the pin 9A is fixed by bringing the pin 9A into contact with a portion in which the inner diameter of a side where the pin hole 2G reaches the discharge groove 2D is decreased by one step and by further inserting a spring pin 9B into the pin hole 2G.

In this manner, the outer peripheral portion of the pin 9A protrudes into the recess 2F through the opening portion to the inner peripheral surface of the recess 2F of the pin hole 2G and is positioned at the further outer peripheral side of the inner bit 2 than the cut-upward portion of the locking surface 6C. Accordingly, even when pressing is released and the compression coil spring 7 causes the engagement convex portion 6 to protrude to the outer peripheral side, the cut-upward portion of the locking surface 6C comes into contact with the protruding pin 9A so as to restrict the protruding. Therefore, in this manner, the engagement convex portion 6 is biased toward the outer peripheral side of the inner bit 2 so as to be retractable, and is radially positioned with respect to the axis line O.

In a state where the cut-upward portion of the locking surface 6C comes into contact with the pin 9A and is radially positioned, the engagement convex portion 6 protrudes from the outer peripheral surface of the distal end portion 2C of the inner bit 2 with a protruding height substantially equal to a height of the outer peripheral surface of the contact portion 2B. In addition, the engagement convex portion 6 is pressed into the recess 2F from this state. In this manner, the engagement convex portion 6 can be embedded so that the protruding end surface 6A is located at the position substantially equal to the position of the outer peripheral surface of the distal end portion 2C of the inner bit 2.

In the ring bit 3, a main body thereof is made of the steel material. As illustrated in FIGS. 14A to 14D, the ring bit 3 has a substantially annular external shape or a cylindrical shape about the axis line O which is coaxial with the casing pipe 1 and the inner bit 2. The inner diameter thereof is equal to the inner diameter of the casing top 1A of the distal end of the casing pipe 1, and accordingly is slightly larger than the outer diameter of the distal end portion 2C of the inner bit 2. In addition, the rear end surface 3A of the ring bit 3 has an annular surface perpendicular to the axis line O. The outer diameter of the rear end surface 3A is equal to the outer diameter of the distal end surface 1C of the casing top 1A. That is, the distal end surface 1C and the rear end surface 3A have annular surfaces which are congruent with each other.

Furthermore, the outer peripheral surface of the ring bit 3 becomes a tapered surface about the axis line O which is gradually increased in diameter from the rear end surface 3A to the distal end side. Thereafter, the outer peripheral surface becomes a cylindrical surface about the axis line O which has a constant outer diameter. In the further distal end side, the outer peripheral surface becomes a tapered surface which is gradually increased in diameter via a neck portion whose cross section along the axis line O has a concavely curved shape, and reaches the distal end surface of the ring bit 3. Therefore, the outer diameter of the ring bit 3 is larger than the outer diameter of the casing pipe 1 and the casing top 1A.

In addition, in the distal end surface of the ring bit 3, the outer peripheral portion thereof is a tapered surface toward the distal end side as the outer peripheral portion goes toward the inner peripheral side, and the inner peripheral portion thereof is a tapered surface toward the distal end side as the inner peripheral portion goes toward the outer peripheral side. Then, the tapered surfaces and a flat surface perpendicular to the axis line O which is formed in the protruding end of the distal end surface where the tapered surfaces intersect each other have tips 5 which are also formed of the hard material such as the ultra-hard alloys, so that multiple tips 5 are each embedded to be respectively perpendicular to each tapered surface and the flat surface.

Furthermore, multiple (three) engagement concave portions 10, the number of which is the same as the number of the engagement convex portions 6 of the inner bit 2, are formed in the inner peripheral portion of the ring bit 3 at equal intervals in the circumferential direction. The engagement convex portions 6 protruding in the outer peripheral of the distal end portion 2C of the inner bit 2 engage with the engagement concave portions 10. This enables the ring bit 3 to be rotated around the axis line O integrally with the inner bit 2 in the rotating direction T during the excavation, and to be locked so as not to slip toward the distal end side in the direction of the axis line O. Then, as described above, the engagement convex portion 6 which is retractable to the outer peripheral side of the inner bit 2 retreats to the inner peripheral side. In this manner, the ring bit 3 locked in the distal end side in the direction of axis line O can be pulled out to the distal end side.

Here, the engagement concave portion 10 is formed to leave a distance with the rear end surface 3A and to be open on the distal end surface of the ring bit 3. The engagement concave portion 10 has a bottom surface 10A facing the inner peripheral side of the ring bit 3, a wall surface 10B facing the rotating direction T side, a wall surface 10C facing the rear side in the rotating direction T and a wall surface 10D facing the distal end side, all of which respectively extend from the bottom surface 10A toward the inner peripheral portion of the ring bit 3. In addition, a circumferential width between the wall surfaces 10B and 10C of one engagement concave portion 10 is wider than a circumferential width of the discharge groove 2D and the engagement convex portion 6 of the inner bit 2, and further is wider than a circumferential distance between the wall surfaces 10C and 10B of the engagement concave portion 10 which are adjacent to each other.

Out of these, the bottom surface 10A has a substantially cylindrical surface shape about the axis line O, and a radius with respect to the axis line O is slightly longer than a distance from the axis line O to the protruding end surface 6A of the engagement convex portion 6 which is radially positioned by protruding to the outer peripheral side of the inner bit 2 as described above. In addition, all of the wall surfaces 10B and 10C of the engagement concave portion 10 is configured so that cross sections orthogonal to the axis line O have concavely curved line shapes which come into smooth contact with a concave arc formed by a cross section of the bottom surface 10A. However, out of these, the wall surface 10C facing the rear side in the rotating direction T has a quarter concave arc shape in cross section, and the radius thereof is smaller than the radius of curvature of the concavely curved line formed by the wall surface 10B, and is approximately equal to the radius of the quarter convex arc shape in cross section which is formed by the chamfered portion formed on the side in the rotating direction T side of the protruding end surface 6A of the engagement convex portion 6.

Furthermore, the wall surface 10D facing the distal end side of the engagement concave portion 10 is configured so that a portion in the rotating direction T side is a flat surface perpendicular to the axis line O and the bottom surface 10A. Here, the distance between the flat surface and the rear end surface 3A of the ring bit 3 is shorter than the distance between the distal end surface 1C of the casing top 1A in a state where the contact portion 2B of the inner bit 2 is brought into contact with the stepped portion 1B of the casing top 1A and the locking surface 6C in the engagement convex portion 6 of the inner bit 2. In addition, the circumferential width of the flat surface is wider than the width of the engagement convex portion 6 in the circumferential direction of the inner bit 2.

On the other hand, the rear side portion in the rotating direction T of the wall surface 10D is formed to be cut out and to be tilted toward the inner peripheral side of the ring bit 3 as the flat surface goes from the bottom surface 10A toward the rear end side, thereby forming a guide wall 10E.

Here, in the present embodiment, as illustrated in FIG. 7A, the guide wall 10E is formed to be tilted at the constant tilt angle θ with respect to the axis line O in the cross section taken along the axis line O. In addition, the circumferential width of the guide wall 10E is also wider than the circumferential width of the engagement convex portion 6.

In order to arrange the above-described ring bit 3 around the distal end portion 2C of the inner bit 2 which protrudes from the distal end of the casing top 1A and to engage the engagement convex portion 6 and the engagement concave portion 10 with each other, the inner bit 2 is first inserted through the rear end side of the casing pipe 1, and the engagement convex portion 6 biased toward the outer peripheral side is brought into contact with the rear end surface of the stepped portion 1B of the casing top 1A. Then, if the inner bit 2 is further inserted to move forward, the chamfered portion facing the distal end side in the direction of the axis line O of the engagement convex portion 6 is guided to a tapered surface formed by the rear end surface of the stepped portion 1B. In this manner, the engagement convex portion 6 is caused to retreat to the inner peripheral side of the inner bit 2, and the protruding end surface 6A of the engagement convex portion 6 is in contact with the inner peripheral surface of the casing top 1A.

Figure 8:
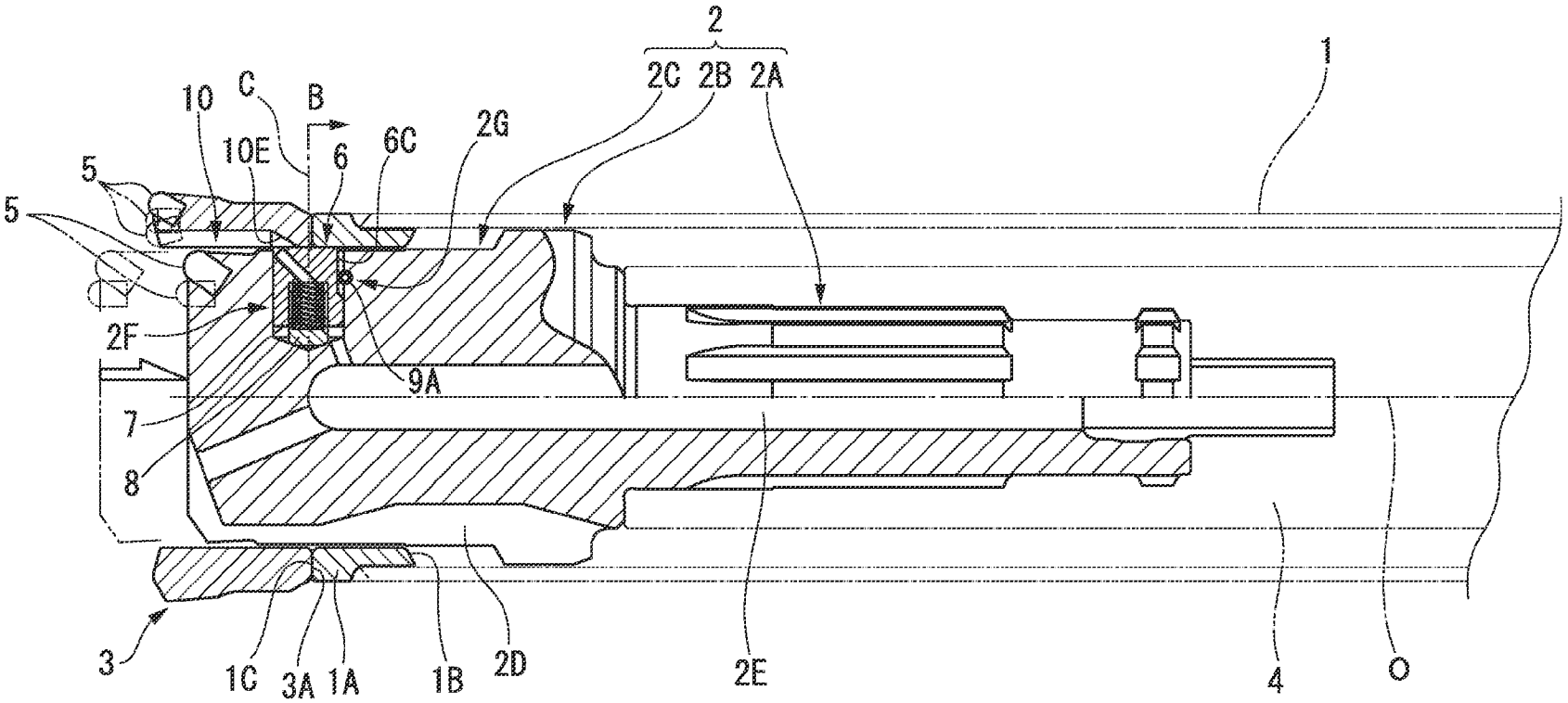
FIG. 8 is a side cross-sectional view (cross-sectional view taken along line AA in FIG. 9) when the engagement convex portion is caused to retreat in the embodiment illustrated in FIG. 1.

Then, the inner bit 2 is caused to further move forward. As illustrated in FIG. 8, in a state where the engagement convex portion 6 is not pulled out to the distal end side of the casing top 1A, a position of the engagement concave portion 10 is aligned with a position of the engagement convex portion 6 in the circumferential direction of the inner bit 2. The periphery of the distal end portion 2C of the inner bit 2 is coaxially covered with the ring bit 3 from the distal end side of the ring bit 3, and the rear end surface 3A of the ring bit 3 is held by being brought into contact with the distal end surface 1C of the casing top 1A. Then, if the inner bit 2 is caused to further move forward, the engagement convex portion 6 moves from a position of being in contact with the inner peripheral surface of the casing top 1A to a position of being in contact with the inner peripheral portion of the ring bit 3, and reaches the position of the engagement concave portion 10. At this time, the engagement convex portion 6 is protruded to the outer peripheral side by the biasing force of the compression coil spring 7 and is accommodated in the engagement concave portion 10.

Here, as described above, the radius from the axis line O to the front of the bottom surface 10A of the engagement concave portion 10 is longer than the distance from the axis line O to the protruding end surface 6A of the engagement convex portion 6 which protrudes to the outer peripheral side. Therefore, in a state where the engagement convex portion 6 which protrudes in this way is accommodated in the engagement concave portion 10, a distance is slightly left between the protruding end surface 6A and the bottom surface 10A of the engagement concave portion 10 as illustrated in FIG. 7A. As illustrated in FIG. 7A, a radial distance with respect to the axis line O from the inner peripheral surface of the ring bit 3 whose inner diameter is equal to that of the casing top 1A to the protruding end surface 6A of the engagement convex portion 6 is a height h for hooking the engagement convex portion 6.

If the inner bit 2 in which the engagement convex portion 6 is accommodated in the engagement concave portion 10 in this way is rotated in the rotating direction T, as illustrated in FIG. 1, the engagement convex portion 6 is positioned in the rotating direction T side of the engagement concave portion 10. The locking surface 6C perpendicular to the axis line O of the engagement convex portion 6 is caused to oppose the flat surface in the rotating direction T side of the wall surface 10D of the engagement concave portion 10 which is similarly perpendicular to the axis line O. Therefore, in this state, even when the inner bit 2 and the ring bit 3 together with the casing pipe 1 are arranged so that the distal end side in the direction of the axis line O faces downward, since the wall surface 10D is in contact with the locking surface 6C, the ring bit 3 is locked so as not to slip toward the distal end side with respect to the inner bit 2 as described above. Accordingly, the ring bit 3 does not fall out therefrom.

Figure 2:
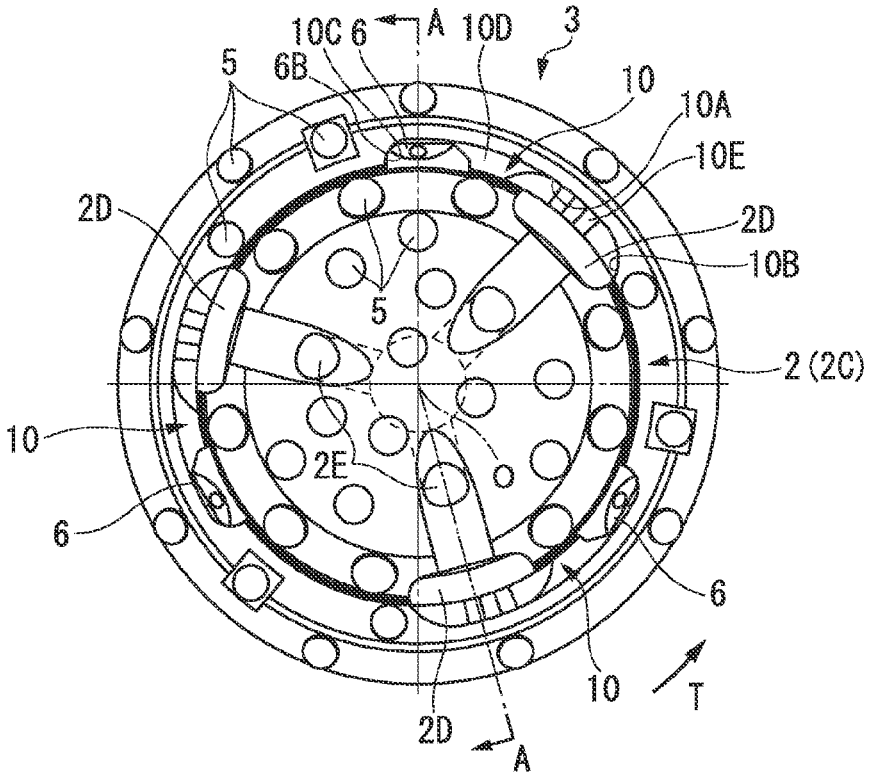
FIG. 2 is an enlarged front view in the embodiment illustrated in FIG. 1.
Figure 3:
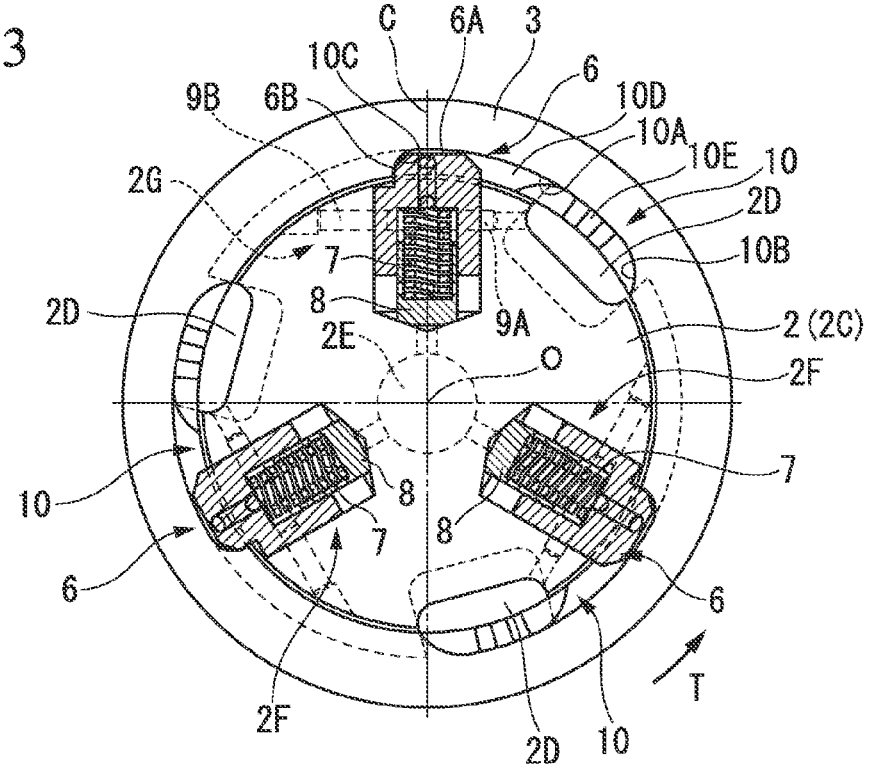
FIG. 3 is an enlarged cross-sectional view taken along line BB in FIG. 1.

In addition, if the inner bit 2 is rotated in the rotating direction T in this way, as illustrated in FIGS. 2 and 3, the engagement surface 6B facing the rotating direction T of the engagement convex portion 6 is caused to oppose the wall surface 10C facing the rear side in the rotating direction T of the engagement concave portion 10. The chamfered portion having a quarter convex arc shape in cross section, which is formed on the side which is positioned in the rotating direction T side of the protruding end surface 6A and where the engagement surface 6B and the protruding end surface 6A of the engagement convex portion 6 intersect each other, comes into contact with the wall surface 10C of the engagement concave portion 10 which forms a quarter concave arc shape in cross section having the radius approximately equal to that of the above-described chamfered portion. Therefore, as described above, the ring bit 3 can be rotated around the axis line O in the rotating direction T during the excavation integrally with the inner bit 2.

Then, a case where the excavating tool configured in this manner is used in forming the bore H downward from the ground so as to reach a predetermined depth, the casing pipe 1 is inserted therein, the inner bit 2 is drawn out from the casing pipe 1, the casing pipe 1 is temporarily used as a temporary pile or the like, and the casing pipe 1 is lifted up from the bore H to be collected on the ground after the use thereof will be described with reference to FIGS. 1 to 10 and 15A to 15D.

First, as described above, when the casing pipe 1, the inner bit 2 and the ring bit 3 are arranged so that the distal end side in the direction of the axis line O faces downward and the excavation is started by applying the rotating force in the rotating direction T and the thrust force toward the distal end side thereof in the direction of the axis line O from the excavator via the excavating rod to the inner bit 2, the stepped portion 1B of the casing top 1A comes into contact with the contact portion 2B of the inner bit 2. In this manner, only the thrust force is transmitted to the casing pipe 1. Therefore, the casing pipe moves forward integrally with the inner bit 2 without being rotated.

In contrast, the ring bit 3 is rotated integrally with the inner bit 2 in the following manner. The ring bit 3 is initially lowered by its own weight, thereby bringing the wall surface 10D of the engagement concave portion 10 into contact with the locking surface 6C of the engagement convex portion 6, and is locked in the distal end side in the direction of the axis line O. As illustrated in FIGS. 2 and 3, while the ring bit 3 remaining in the locked state, the wall surface 10C of the engagement concave portion 10 comes into contact with the chamfered portion of the protruding end side of the engagement surface 6B of the engagement convex portion 6 as described above, and the ring bit 3 is rotated integrally with the inner bit 2. Then, when the distal end of the ring bit 3 comes into contact with the ground, the ring bit 3 is pressed upward to the rear end side in the direction of the axis line O with respect to the inner bit 2 and the casing pipe 1. Then, as illustrated in FIG. 1, the rear end surface 3A is in a contact state with the distal end surface 1C of the casing top 1A.

Figure 15A:
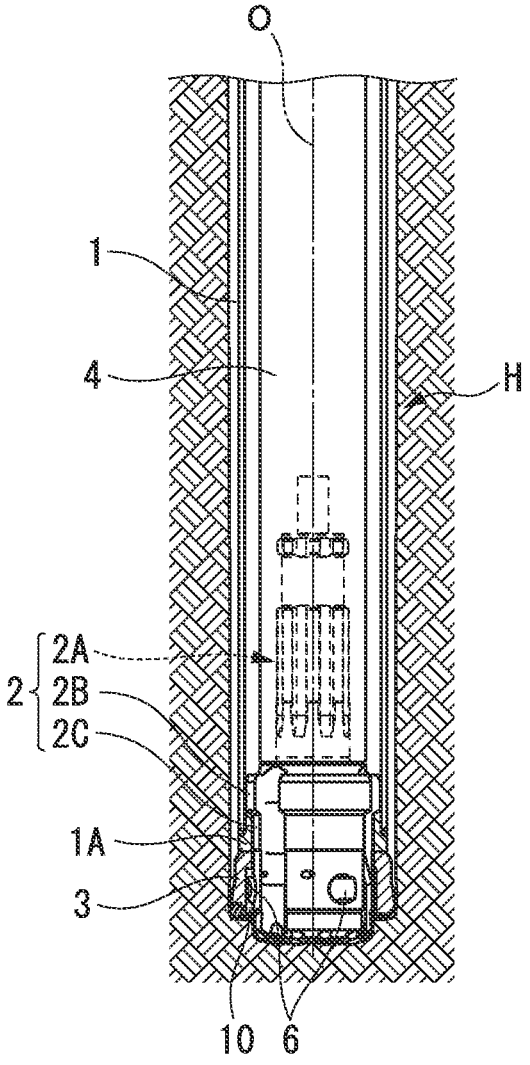
FIG. 15A is a cross-sectional view when a bore is formed during excavation according to the embodiment illustrated in FIG. 1.

If from this state, the bore H is formed by supplying the compressed air to the down-the-hole hammer 4 and applying the striking force toward the distal end side in the direction of axis line O to the inner bit 2, the striking force and the thrust force are transmitted from the contact portion 2B via the stepped portion 1B to the casing top 1A and the casing pipe 1, and is also transmitted from the distal end surface 1C of the casing top 1A via the rear end surface 3A to the ring bit 3. Then, the striking force, the thrust force together with the rotating force directly applied from the inner bit 2 cause the inner bit 2 and the ring bit 3 to carry out the excavation work as illustrated in FIG. 15A. The casing pipe 1 is inserted into the bore H formed in this way by using the striking force and the thrust force which are transmitted to the casing top 1A.

While the excavation work is carried out in this way, the ring bit 3 is in the contact state with the ground. Accordingly, the rear end surface 3A is exclusively kept in contact with the distal end surface 1C of the casing top 1A, and the striking force and the thrust force from the casing top 1A are transmitted to the ring bit 3. In addition, even when impact due to the striking force causes the ring bit 3 to be separated from the casing top 1A and to jump out to the distal end side, the wall surface 10D of the engagement concave portion 10 is locked by being in contact with the locking surface 6C of the engagement convex portion 6 of the inner bit 2. Accordingly, the ring bit 3 does not fall out therefrom.

Furthermore, during the excavation, the exhaust gas of the compressed air supplied to the down-the-hole hammer 4 is discharged through the blow hole 2E of the inner bit 2 to the discharge groove 2D. The exhaust air causes the sludge generated during the excavation to be sent to the rear end side in the direction of the axis line O through the discharge groove 2D and to be discharged from the inside of the casing pipe 1. The exhaust air is also supplied to the recess 2F via the divided hole extending from the blow hole 2E across the bottom surface of the recess 2F. The exhaust air supplied to the recess 2F flows into the recessed hole 6D of the engagement convex portion 6 from the through-hole 8A of the holding member 8 through a gap of the compression coil spring 7, and is discharged toward the distal end side into the engagement concave portion 10 of the ring bit 3 through the small-diameter hole extending from the center of the hole bottom of the recessed hole 6D.

Figure 4:
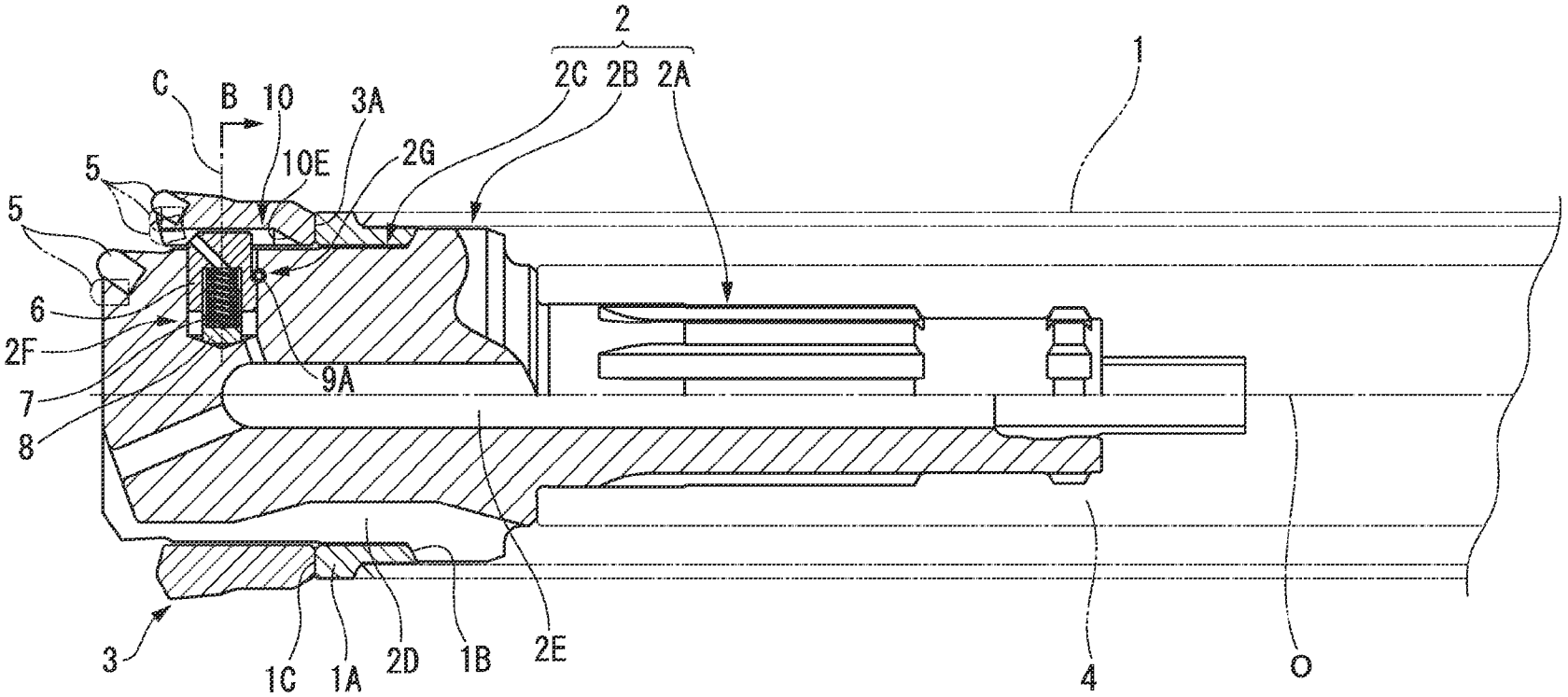
FIG. 4 is a side cross-sectional view (cross-sectional view taken along line AA in FIG. 5) when engagement is disengaged between an engagement concave portion and an engagement convex portion in the embodiment illustrated in FIG. 1.
Figure 5:
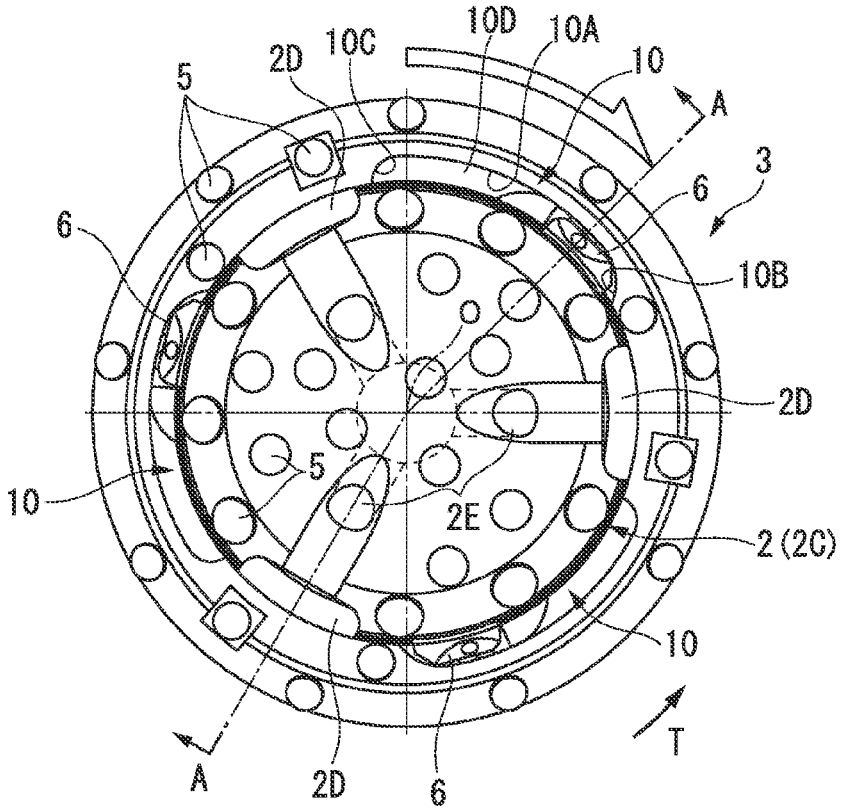
FIG. 5 is an enlarged front view in the embodiment illustrated in FIG. 4.
Figure 6:
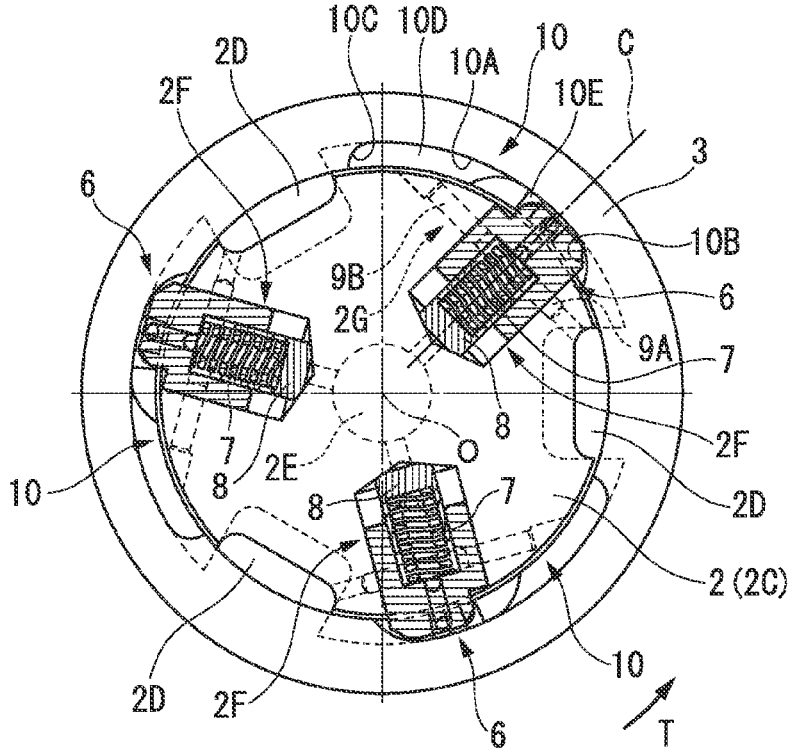
FIG. 6 is an enlarged cross-sectional view taken along line BB in FIG. 4.

Then, in order to draw out the inner bit 2 from the casing pipe 1 after the bore H is formed to reach the predetermined depth and the casing pipe 1 is inserted in this way, the inner bit 2 is first rotated in a direction opposite to the rotating direction T during the excavation as illustrated by a white arrow in FIG. 5. As illustrated in FIGS. 4 to 6, the engagement convex portion 6 is positioned at the distal end side in the direction of the axis line O of the guide wall 10E on the wall surface 10D of the engagement concave portion 10.

Figure 9:
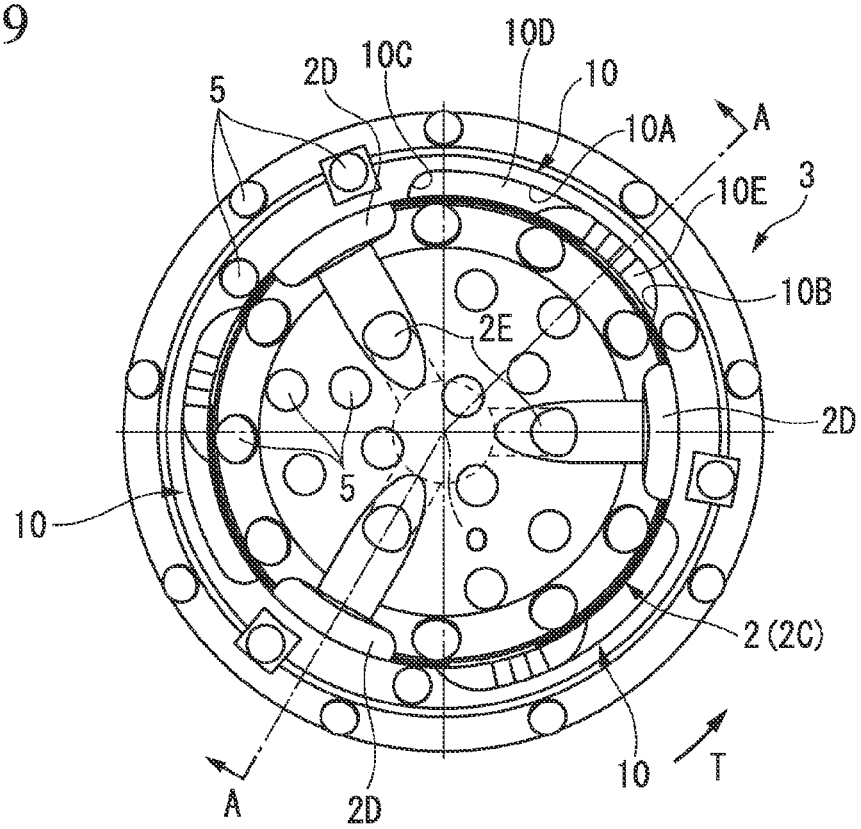
FIG. 9 is an enlarged front view in an embodiment illustrated in FIG. 8.
Figure 10:
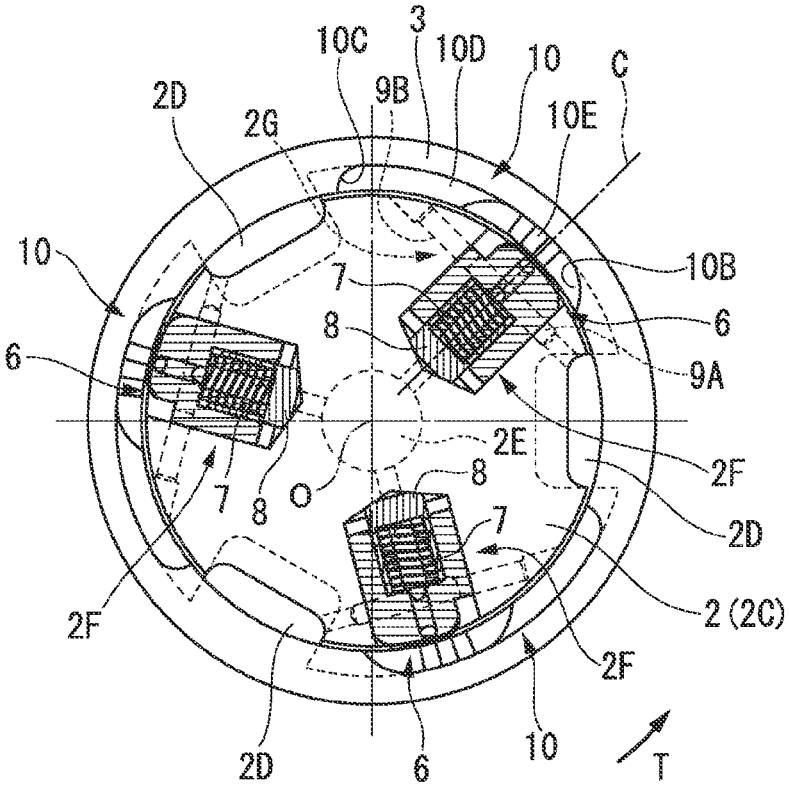
FIG. 10 is an enlarged cross-sectional view taken along line BB in FIG. 8.
Figure 11:
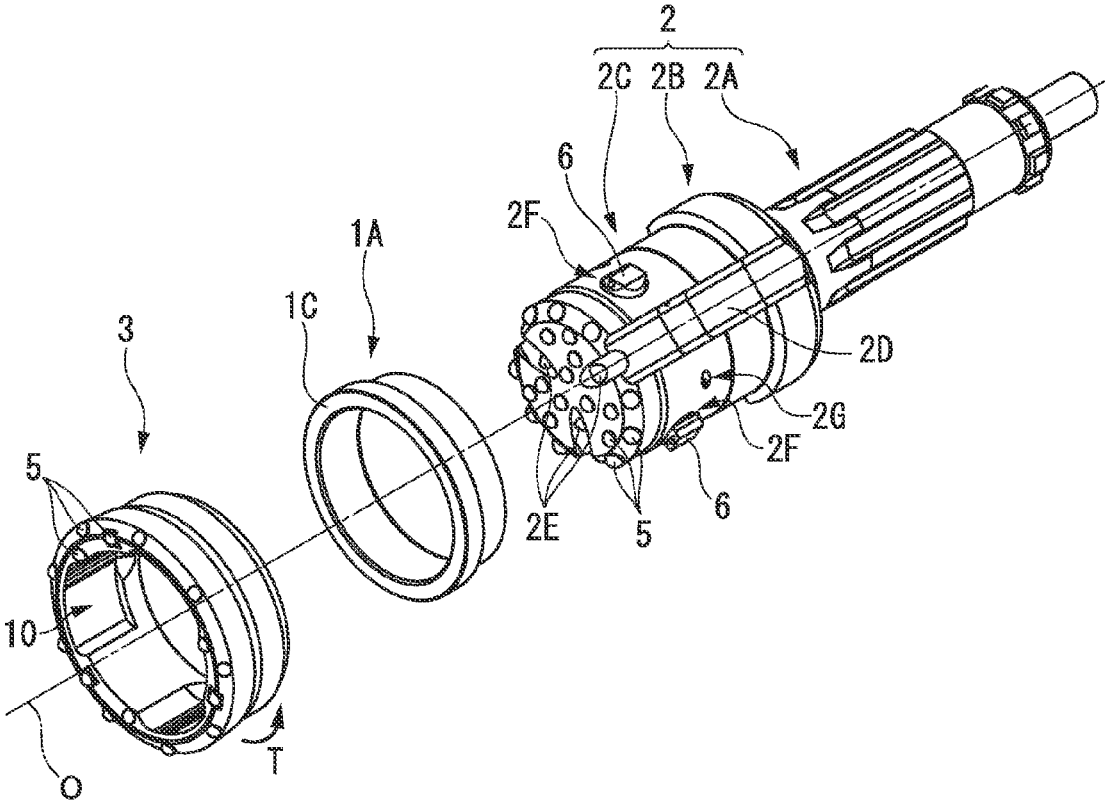
FIG. 11 is a perspective view illustrating a ring bit, casing top (distal end portion of a casing pipe) and the inner bit in the embodiment illustrated in FIG. 1.

Then, if from this state, the inner bit 2 together with the excavating rod and the down-the-hole hammer 4 are caused to retreat to the rear end side in the direction of the axis line O, as illustrated in FIG. 7A, an intersection ridge line between the protruding end surface 6A of the engagement convex portion 6 and the locking surface 6C comes into contact with the guide wall 10E. If the inner bit 2 together with the excavating rod and the down-the-hole hammer 4 are caused to further retreat, as illustrated in FIGS. 7B, 9 and 10, the engagement convex portion 6 is retracted inside the recess 2F by retreating to the inner peripheral side in the radial direction of the inner bit 2 against the biasing force generated by the compression coil spring 7 so as to be guided along the guide wall 10E. Then, the intersection ridge line between the protruding end surface 6A and the locking surface 6C comes into contact with the inner peripheral surface of the ring bit 3.

Figure 15B:
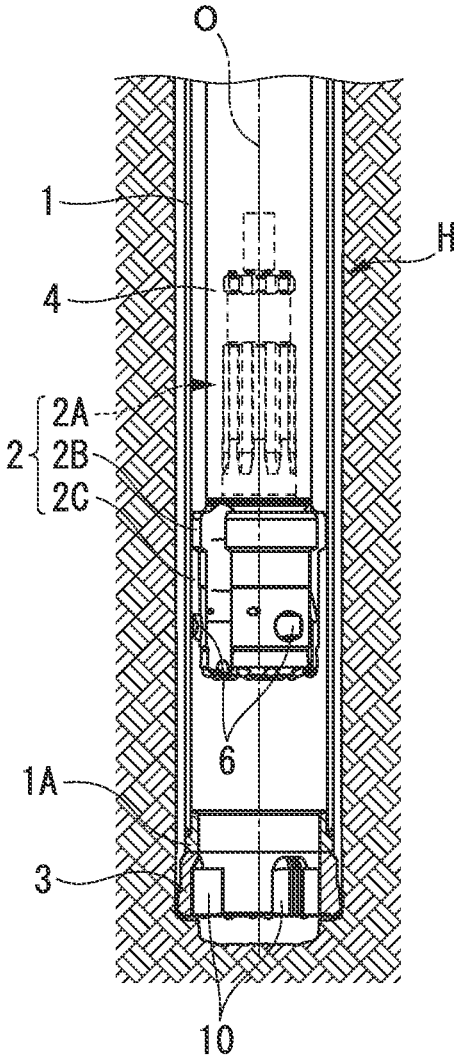
FIG. 15B is a cross-sectional view when the inner bit is drawn out from the casing pipe during excavation according to the embodiment illustrated in FIG. 1.

Therefore, as illustrated by the white arrow in FIG. 8, if the inner bit 2 is caused to retreat as it is, the protruding end surface 6A of the engagement convex portion 6 comes into sliding contact with the inner peripheral surface of the casing top 1A from the inner peripheral surface of the ring bit 3. The distal end portion 2C of the inner bit 2 is pulled out from the inner peripheral portion of the ring bit 3 and the casing top 1A, and protrudes to the outer peripheral side again when the engagement convex portion 6 crosses over the casing top 1A. However, the outer diameter of the engagement convex portion 6 is smaller than the inner diameter of the casing pipe 1. Accordingly, the retreat of the inner bit 2 is no longer restricted thereafter. Therefore, as illustrated in FIG. 15B, it is possible to pull out the inner bit 2 from the casing pipe 1.

Figure 15C:
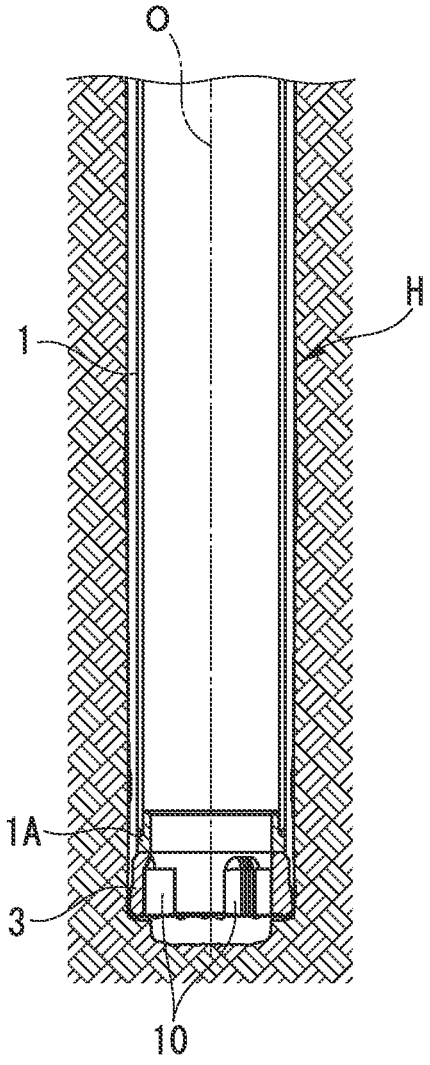
FIG. 15C is a cross-sectional view when the inner bit has been drawn out during excavation according to the embodiment illustrated in FIG. 1.
Figure 15D:
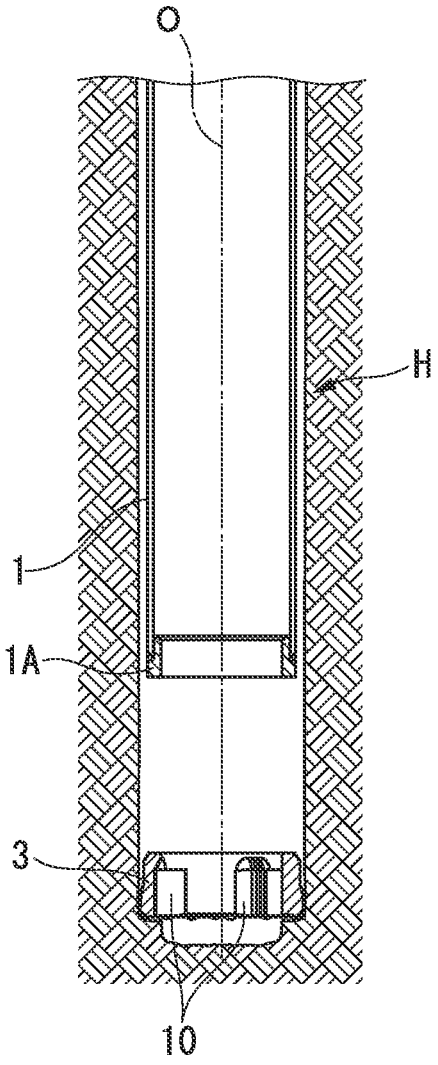
FIG. 15D is a cross-sectional view when the casing pipe is lifted up from the bore during excavation according to the embodiment illustrated in FIG. 1.

Then, when the inner bit 2 is further pulled out in this way, the ring bit 3 can be pulled out from the casing pipe 1, since the rear end surface 3A of the ring bit 3 is only in a contact state with the distal end surface 1C of the casing top 1A as illustrated in FIG. 15C. Therefore, after the casing pipe 1 is temporarily used as described above, it is possible to leave the ring bit 3 in the hole bottom of the bore H and to draw out and collect only the casing pipe 1 from the bore H only by lifting up the casing pipe 1 as it is as illustrated in FIG. 15D.

In this manner, according to the excavating tool configured as described above, the engagement convex portion 6 of the inner bit 2 protrudes to the outer peripheral side and engages with the engagement concave portion 10 of the ring bit 3 during the excavation. Accordingly, the excavation work can be carried out since the ring bit 3 is locked so as not to slip out from the inner bit 2 by being locked in the distal end side in the direction of the axis line O and can be rotated around the axis line O integrally with the inner bit 2 in the rotating direction T during the excavation. On the other hand, in order to pull out the ring bit 3 after the excavation work is completed, the inner bit 2 only has to be caused to retreat so that the engagement convex portion 6 is retracted to the inner peripheral side. Therefore, it is not necessary to dispose the second inner bit as in the excavating tool disclosed in PTL 3.

Therefore, it is not necessary to prepare the second inner bit as described above, or in particular to insert the second inner bit into the hole bottom by connecting the excavating rod when the bore H is deep. It is possible to collect the casing pipe 1 while efficiently leaving the ring bit 3 as it is. Moreover, since the bore H is formed by the ring bit 3 whose diameter is larger than that of the casing pipe 1, the inner diameter of the bore H is larger than the outer diameter of the casing pipe 1 as illustrated in FIG. 15D. Therefore, since there is no possibility that great resistance may occur when the casing pipe 1 is drawn out, the collection work can also be facilitated.

Figure 16A:
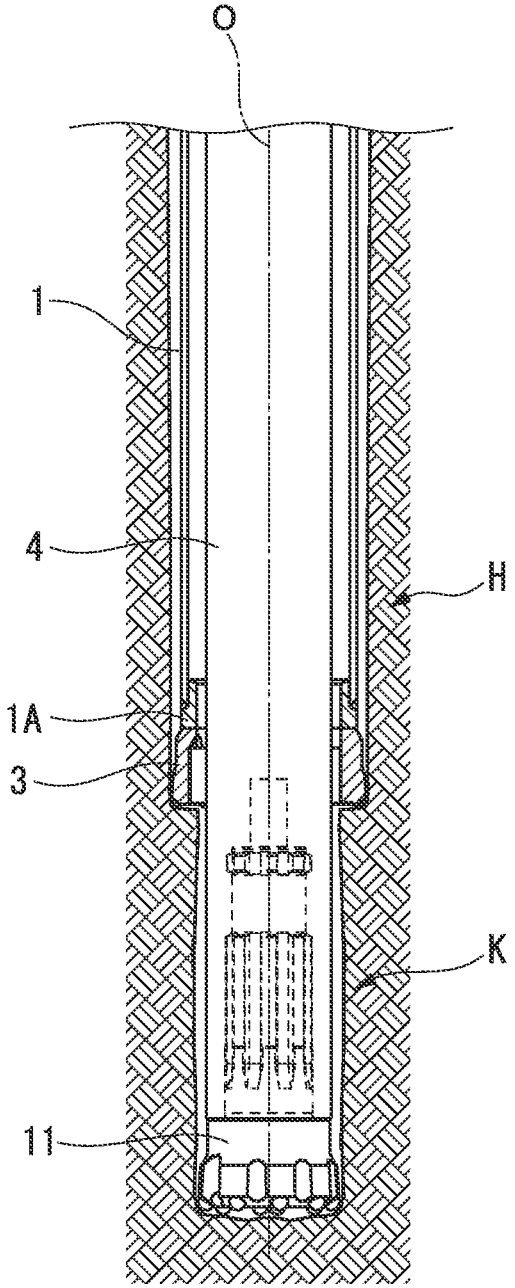
FIG. 16A is a cross-sectional view in a state where the bore is further formed by using a second inner bit, which is changed from the state illustrated in FIG. 15C.
Figure 16B:
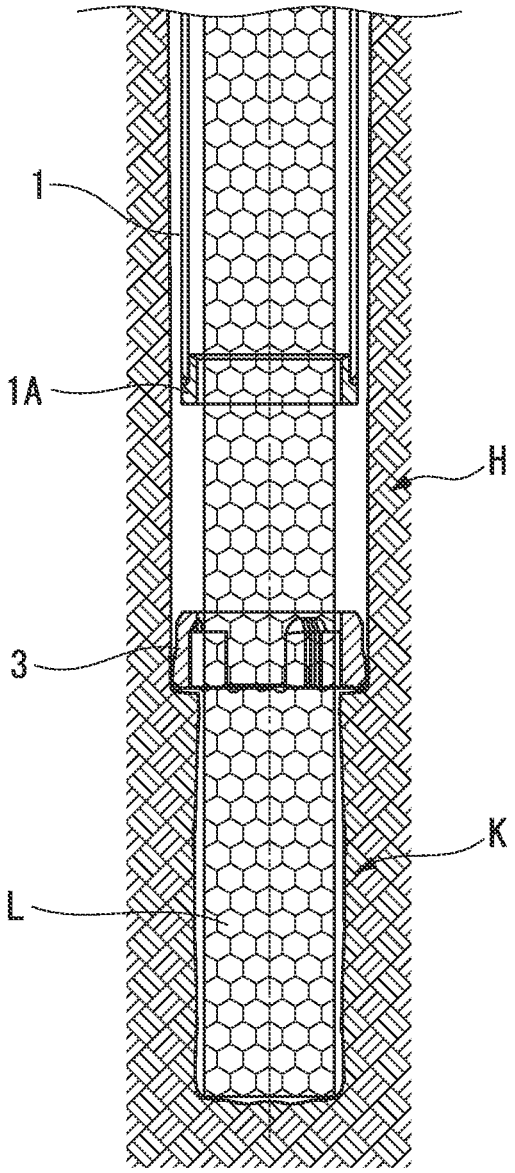
FIG. 16B is a cross-sectional view in a state where a building member is inserted into the bore which is formed to be deeper in FIG. 16A and the casing pipe is lifted up from the bore, which is changed from the state illustrated in FIG. 15C.

However, as illustrated in FIG. 16B which is changed from the state illustrated in FIG. 15C, when another extended bore K is further formed downward from the hole bottom of the bore H formed to reach the predetermined depth and a building member L is to be inserted, the inner bit 2 is pulled out from the casing pipe 1. Thereafter, an excavating bit 11 as illustrated in FIG. 16A may be used which has a slightly smaller outer diameter than the inner diameter of the casing top 1A and the ring bit 3 and does not engage with the ring bit 3.

In this case, as illustrated in FIG. 16A, the excavating bit 11 passing through the casing pipe 1 is brought into contact with the hole bottom of the bore H from the inner peripheral portion of the casing top 1A and the ring bit 3 so as to carry out the excavation work. In this manner, the bore K is formed to reach a predetermined depth. Then, the excavating bit 11 is drawn out and the building member L is inserted as illustrated in FIG. 16B. Thereafter, the casing pipe 1 may be drawn out and collected from the bore H by leaving the ring bit 3.

Even in this case, according to the excavating tool configured as described above, it is possible to easily collect the casing pipe 1 without receiving the great resistance acting in drawing out the casing pipe 1.

In addition, in the present embodiment, the contact portion 2B of the inner bit 2 comes into contact with the stepped portion 1B of the casing top 1A in the casing pipe 1, and the engagement convex portion 6 of the inner bit 2 engages with the engagement concave portion 10 of the inner peripheral portion of the ring bit 3. In this state, the rear end surface 3A of the ring bit 3 can come into contact with the distal end surface 1C of the casing top 1A, and the thrust force and the striking force which are applied to the inner bit 2 can be transmitted to the ring bit 3 via the casing top 1A. Therefore, unlike the excavating tool disclosed in PTLs 1 and 3 which directly transmits the thrust force and the striking force from the inner bit to the ring bit, it is not necessary to further form a stepped portion of the ring bit in the distal end side of the stepped portion of the casing top so as to have a decreased diameter in the inner peripheral side.

Therefore, as in the present embodiment, the inner diameter of the casing top 1A and the inner diameter of the ring bit 3 can be arranged to be equal to each other. In this manner, it is possible to arrange the inner diameter of the ring bit 3 so as not to be smaller than the inner diameter of the casing top 1A. Therefore, even when forming the bore H having the same inner diameter, it is possible to thin the thickness of the ring bit 3. Alternatively, even when inserting the building member L into the bore K extended as described above, it is possible to use the casing pipe 1 having a small inner diameter for the building member L having the same outer diameter. Therefore, it is possible to reduce the excavation cost.

Furthermore, in the present embodiment, in order for the engagement convex portion 6 to be retractable to the outer peripheral side of the distal end portion 2C of the inner bit 2, the engagement convex portion 6 is biased toward the outer peripheral side by using the biasing means such as the compression coil spring 7 and is held in the recess 2F of the inner bit 2. On the other hand, in the engagement concave portion 10 of the ring bit 3 with which the protruding engagement convex portion 6 engages, the guide wall 10E tilting toward the inner peripheral side of the ring bit 3 as it goes toward the rear end side is formed in the rear side in the rotating direction T of the wall surface 10D facing the distal end side of the rear end portion.

Therefore, after the excavation work is completed, the inner bit 2 is rotated to the rear side in the rotating direction T during the excavation and the engagement convex portion 6 is arranged on the distal end side of the guide wall 10E as described above. By causing the inner bit 2 to retreat to the rear end side in the direction of the axis line O as it is, the engagement convex portion 6 is guided while coming into sliding contact with the guide wall 10E. The engagement convex portion 6 is pressed and caused to retreat to the inner peripheral side of the inner bit 2 against the biasing force, and is separated from the engagement concave portion 10. Therefore, it is possible to reliably pull out the inner bit 2 from the ring bit 3 by relatively easily disengaging the engagement between the engagement convex portion 6 and the engagement concave portion 10. On the other hand, the engagement convex portion 6 is positioned in the rotating direction T side of the engagement concave portion 10 during the excavation, and the wall surface 10D perpendicular to the axis line O of the engagement concave portion 10 is arranged in the rear end side in the direction of the axis line O. Then, the wall surface 10D comes into contact with the locking surface 6C of the engagement convex portion 6 which is similarly perpendicular to the axis line O, thereby the ring bit 3 is locked. Therefore, the ring bit 3 does not fall out therefrom inadvertently.

Furthermore, in the present embodiment, in order to prevent the ring bit 3 from falling out, the spring constant K (N/mm) of the compression coil spring 7 serving as the biasing means for biasing the engagement convex portion 6 toward the outer peripheral side of the inner bit 2 is configured to be $K>W/(\tan\theta\times h\times n)$ when the weight W (N) of the ring bit 3, the tilt angle $\theta(°)$ of the guide wall 10E with respect to the axis line O, the height h (mm) for hooking the engagement convex portion 6, which is the radial distance with respect to the axis line O from the inner peripheral surface of the ring bit 3 to the protruding end of the engagement convex portion 6 protruding to the outer peripheral side of the inner bit 2, and the number n of the engagement convex portions 6 disposed in the inner bit 2 are respectively set.

Therefore, even when the excavation work is carried out by causing the distal end side in the direction of the axis line O to face downward as described above, in a state where the engagement convex portion 6 is only in contact with the guide wall 10E, there is no possibility that the weight W of the ring bit 3 may cause the engagement convex portion 6 to retreat to the inner peripheral side of the inner bit 2 while coming into sliding contact with the guide wall 10E against the biasing force of the compression coil spring 7. Therefore, it is possible to prevent a situation where the ring bit 3 inadvertently slips out due to its own weight during the excavation and the subsequent excavation work is no longer possible.

However, the above-described expression represents the minimum condition for a case where the ring bit 3 does not fall out due to its own weight. In order to more reliably prevent the ring bit 3 from falling out and to draw out the inner bit 2 by causing the engagement convex portion 6 to relatively smoothly retreat when leaving the ring bit 3, it is preferable that the spring constant K (N/mm) of the compression coil spring 7 be in a range up to approximately eight times as much as $W/(\tan\theta\times h\times n)$.

INDUSTRIAL APPLICABILITY

According to the present invention, it is possible to insert a casing pipe into a bore while forming the bore by using an inner bit and a ring bit during excavation. After the bore is formed to reach a predetermined depth, it is not necessary to dispose a second inner bit or to dispose an excavating rod for being additionally connected to a rear end side of the second inner bit. An engagement convex portion of the inner bit is caused to retreat so as to allow the ring bit to be retractable. In this manner, it is possible to efficiently lift up and collect only the casing pipe from the bore by leaving the ring bit in the bore. Therefore, the present invention has industrial applicability.

REFERENCE SIGNS LIST

1 casing pipe
1A casing top
1B stepped portion
1C distal end surface of casing top 1A
2 inner bit
2B contact portion
2C distal end portion of inner bit 2
2F recess
3 ring bit
3A rear end surface of ring bit 3
5 tip
6 engagement convex portion
7 compression coil spring
10 engagement concave portion
10E guide wall
O axis line of casing pipe
T rotating direction of inner bit 2 during excavation
θ tilt angle with respect to axis line O of guide wall 10E
h height for hooking engagement convex portion 6

The invention claimed is:

1. An excavating tool comprising:

a casing pipe that forms a cylindrical shape about an axis line and in which a stepped portion whose inner diameter is decreased by one step is formed in an inner peripheral portion of a distal end;

an inner bit which has a contact portion which can come into contact with the stepped portion on an outer periphery, and is inserted into the casing pipe from a rear end side in the direction of the axis line to protrude its distal end portion from a distal end of the casing pipe;

an engagement convex portion that is disposed on the outer periphery of the distal end portion of the inner bit so as to be retractable;

a ring bit that forms an annular shape and is arranged around the distal end portion of the inner bit protruding from the distal end of the casing pipe; and an engagement concave portion that is formed in an inner peripheral portion of the ring bit, wherein in such a manner that the engagement convex portion protrudes to an outer peripheral side and engages with the engagement concave portion, the ring bit is rotatable around the axis line integrally with the inner bit in a rotating direction during excavation, and the ring bit is locked so as not to be pulled out to the distal end side of the inner bit in the direction of the axis line, wherein the engagement convex portion is caused to retreat to an inner peripheral side, thereby the ring bit is capable of being pulled out to the distal end side of the inner bit, and wherein an outer diameter of the engagement convex portion is smaller than an inner diameter of the casing pipe.

2. The excavating tool according to claim 1, wherein in a state where the contact portion is in contact with the stepped portion and the engagement convex portion engages with the engagement concave portion, a rear end surface of the ring bit can come into contact with a distal end surface of the casing pipe.

3. The excavating tool according to claim 1, wherein the engagement convex portion is biased toward the outer peripheral side and is disposed so as to be retractable to the outer periphery of the distal end portion of the inner bit, and wherein a guide wall tilting toward an inner peripheral side of the ring bit as the ring bit goes toward a rear end side is formed in a rear end portion of the engagement concave portion.

4. The excavating tool according to claim 3, wherein the engagement convex portion is biased toward the outer peripheral side by a compression coil spring, and wherein spring constant K (N/mm) of the compression coil spring is configured to be $K>W/(\tan\theta\times h\times n)$ when an weight W (N) of the ring bit, a tilt angle θ(°) of the guide wall with respect to the axis line, a height h (mm) for hooking the engagement convex portion, which is a radial distance with respect to the axis line from an inner peripheral surface of the ring bit to a protruding end of the engagement convex portion protruding to the outer peripheral side of the inner bit, and the number n of the engagement convex portions disposed in the inner bit are respectively set.

5. The excavating tool according to claim 2, wherein the engagement convex portion is biased toward the outer peripheral side and is disposed so as to be retractable to the outer periphery of the distal end portion of the inner bit, and wherein a guide wall tilting toward an inner peripheral side of the ring bit as the ring bit goes toward a rear end side is formed in a rear end portion of the engagement concave portion.

6. The excavating tool according to claim 5, wherein the engagement convex portion is biased toward the outer peripheral side by a compression coil spring, and wherein spring constant K (N/mm) of the compression coil spring is configured to be $K>W/(\tan\theta\times h\times n)$ when an weight W (N) of the ring bit, a tilt angle θ(°) of the guide wall with respect to the axis line, a height h (mm) for hooking the engagement convex portion, which is a radial distance with respect to the axis line from an inner peripheral surface of the ring bit to a protruding end of the engagement convex portion protruding to the outer peripheral side of the inner bit, and the number n of the engagement convex portions disposed in the inner bit are respectively set.

* * * * *